US007854487B2

(12) United States Patent
Yamanobe

(10) Patent No.: US 7,854,487 B2
(45) Date of Patent: Dec. 21, 2010

(54) IMAGE FORMING METHOD AND APPARATUS

(75) Inventor: Jun Yamanobe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 164 days.

(21) Appl. No.: 12/345,352

(22) Filed: Dec. 29, 2008

(65) Prior Publication Data

US 2009/0115811 A1 May 7, 2009

Related U.S. Application Data

(62) Division of application No. 11/127,293, filed on May 12, 2005, now Pat. No. 7,484,822.

(30) Foreign Application Priority Data

May 14, 2004 (JP) ..... 2004-145335

(51) Int. Cl.
*B41J 2/205* (2006.01)

(52) U.S. Cl. ..... 347/15; 347/41; 347/43

(58) Field of Classification Search ..... 347/9, 347/12, 14, 15, 40–43
See application file for complete search history.

(56) References Cited

U.S. PATENT DOCUMENTS 5,500,661 A 3/1996 Matsubara et al.
5,975,678 A * 11/1999 Kanematsu et al. ..... 347/43
6,164,745 A 12/2000 Nagoshi et al.
6,302,508 B1 10/2001 Asauchi et al.
6,779,865 B2 8/2004 Shibata et al.
7,004,562 B2 * 2/2006 Madeley ..... 347/42
2002/0021325 A1 2/2002 Koitabashi et al.

FOREIGN PATENT DOCUMENTS

JP 6-155768 A 6/1994
JP 8-72228 A 3/1996
JP 9-24609 A 1/1997
JP 9-272198 A 10/1997
JP 2002-19101 A 1/2002
JP 2003-94620 A 4/2003

* cited by examiner

*Primary Examiner*—Thinh H Nguyen
(74) *Attorney, Agent, or Firm*—Birch, Stewart, Kolasch & Birch, LLP

(57) ABSTRACT

The image forming method for forming an image on a recording medium, wherein the image is divided into a plurality of regions, the method comprising: a droplet deposition rate calculation step; a dot arrangement specification step of specifying a dot arrangement pattern from the droplet deposition rate; and a droplet deposition control step of controlling droplet deposition operation in such a manner that the dot arrangement pattern specified in the dot arrangement specification step is achieved, wherein, in at least one of the plurality of the regions where the droplet deposition rate is lower than a maximum droplet deposition rate and is higher than a prescribed reference value, a dot line in a main scanning direction substantially perpendicular to the relative conveyance direction is formed in which the dots are continuously aligned so as to mutually overlap by a prescribed overlap ratio, in accordance with the droplet deposition rate.

7 Claims, 16 Drawing Sheets

IMAGE FORMING METHOD AND APPARATUS

This application is a Divisional of application Ser. No. 11/127,293 filed on May 12, 2005, now U.S. Pat. No. 7,484,822 and for which priority is claimed under 35 U.S.C. §120; and this application claims priority of Application No. 2004-145335, filed in Japan on May 14, 2004 under 35 U.S.C. §119; the entire contents of all are hereby incorporated by reference.

BACKGROUND OF THE INVENTION

1. Field of the Invention

The present invention relates to an image forming method and apparatus, and more particularly, to droplet deposition control technology suitable for reducing deterioration of image quality caused by ejection failure of a droplet ejection port (nozzle) of an inkjet recording apparatus or other image forming apparatus comprising an ejection head having a nozzle row in which a plurality of nozzles are arranged through a length corresponding to the entire width of a recording medium.

2. Description of the Related Art

In an inkjet printer, for a variety of reasons, a situation may occur in which it becomes impossible to eject ink from a nozzle. If a particular nozzle of the nozzle group suffers an ejection failure, then dots that should originally have been formed on the recording medium by that nozzle are missing, and an unintended stripe-shaped defect (stripe non-uniformity or "banding") is thereby produced in the image formed on the recording medium. This banding is extremely conspicuous.

In particular, in the case of a device configuration that completes printing by means of a single sub-scanning operation, using a line-type recording head in which a plurality of nozzles are arranged, unlike a shuttle (multi) scanning system, it is difficult to cover the droplet deposition position of a nozzle suffering an ejection failure, by means of another nozzle (in other words, a so-called "shingling" operation), and banding non-uniformity due to the nozzle suffering the ejection failure is highly notable, leading to serious deterioration in image quality. Japanese Patent Application Publication Nos. 2002-19101 and 2002-67297 disclose methods by which, if any of the nozzles in the print head is suffering an ejection failure, deterioration in image quality thereby caused is made to be inconspicuous.

Japanese Patent Application Publication No. 2002-19101 discloses the supplement of dots by means of a nozzle on a head of another color, instead of the nozzle that has become unable to perform recording due to an ejection failure. For example, a supplementary droplet ejection is made for the position of an ejection failure in a cyan head, by means of a nozzle on a magenta head.

Japanese Patent Application Publication No. 2002-67297 discloses a method whereby a large quantity of a printing-property-improving ink is deposited in the area of a deposition failure and the vicinity thereof so that the ink surrounding (neighboring) the line to have been printed by the nozzle suffering an ejection failure is drawn towards the defective area, thereby reducing the perceptibility of banding.

The supplementary (corrective) methods disclosed Japanese Patent Application Publication Nos. 2002-19101 and 2002-67297, however, indicate measures adopted after it has been identified by a method of some kind that a nozzle is suffering an ejection failure. In other words, they incorporate a step for "detection of ejection failures", which is not required directly for printing, and therefore efficiency is poor.

SUMMARY OF THE INVENTION

The present invention has been contrived in view of the above-described circumstances, and an object thereof is to provide an image forming method and apparatus whereby it is possible to reduce the perceptibility of the deterioration in image quality due to defective nozzles, without passing through a step for detecting ejection failures, and the like.

In order to attain the aforementioned object, the present invention is directed to an image forming method for forming an image on a recording medium by forming dots on the recording medium by depositing droplets on the recording medium by a recording head having a plurality of nozzles ejecting the droplets while moving the recording head and the recording medium relatively to each other by conveying at least one of the recording head and the recording medium in a relative conveyance direction, wherein the image to be formed is divided into a plurality of regions; a density in each of the plurality of regions is set as a prescribed density so as to form the image; a droplet deposition rate is defined as a ratio of a number of the dots actually formed by depositing the droplets from one of the nozzles within each of the plurality of regions with respect to a maximum number of the dots formable by depositing the droplets from the one of the nozzles within the region; and tonal gradation in the image is represented by means of a collection of the dots based on a dot arrangement specified according to the droplet deposition rate calculated from image data of the image to be formed, the image forming method comprising: a droplet deposition rate calculation step of calculating the droplet deposition rate from the image data; a dot arrangement specification step of specifying a dot arrangement pattern from the droplet deposition rate calculated in the droplet deposition rate calculation step; and a droplet deposition control step of controlling droplet deposition operation performed by the recording head in such a manner that the dot arrangement pattern specified in the dot arrangement specification step is achieved, wherein, in at least one of the plurality of the regions where the droplet deposition rate calculated in the droplet deposition rate calculation step is lower than a maximum droplet deposition rate and is higher than a prescribed reference value, a dot line in a main scanning direction substantially perpendicular to the relative conveyance direction is formed in which the dots are continuously aligned so as to mutually overlap by a prescribed overlap ratio, in accordance with the droplet deposition rate calculated in the droplet deposition rate calculation step.

According to the present invention, when dividing an image to be printed into a plurality of regions, and realizing a dot arrangement in such a manner that a prescribed density determined from the image data is achieved in each region, in a region where the calculated droplet deposition rate is lower than the maximum droplet deposition rate, which means droplet deposition for the maximum number of dots which can be formed (in other words, a full solid image), and higher than a prescribed reference value, a dot line (dot row) aligned in the main scanning direction is formed in accordance with the droplet deposition rate, and in forming this dot line, adjacent droplets are deposited so as to mutually overlap by a prescribed overlap rate. Therefore, even if a certain nozzle has suffered an ejection error, a portion of the missing dot is covered by the adjacent dots formed by other nozzles and hence banding caused by ejection errors is not conspicuous. Furthermore, in the present invention, it is possible to reduce the perceptibility of missing dots in a case where ejection errors have occurred, without having to include a step for detecting ejection errors in the nozzles.

In the dot arrangement specification step according to the present invention, the tonal gradation is preferably represented in such a manner that the droplet deposition rate is substantially the same for all of the nozzles which deposit droplets within each particular region.

The prescribed reference value is preferably set as a boundary condition which defines whether or not stripe non-uniformity (banding) between respective dot lines in the main scanning direction can be perceived.

Preferably, Dmin being a minimum dot diameter of the dots constituting the dot line in the main scanning direction, and Pt being a pitch between the dots mutually adjacent in the main scanning direction, satisfy the following relationship: $Dmin/2 \geqq Pt$.

It is desirable that this condition be satisfied, since in this case, the central region of a missing dot caused by an ejection error is covered by the adjacent dots, and therefore the perceptibility of image deterioration can be reduced further.

Preferably, in at least one of the plurality of the regions where the droplet deposition rate calculated in the droplet deposition rate calculation step is lower than a prescribed reference value, an oblique dot line in a direction oblique to the main scanning direction is formed in which the dots are continuously aligned so as to mutually overlap by a prescribed overlap ratio, in accordance with the droplet deposition rate calculated in the droplet deposition rate calculation step. More specifically, it is preferable that, in a region of high droplet deposition rate, dot lines are formed in the main scanning direction, and in a region of low droplet deposition rate, droplet deposition control is switched in such a manner that oblique dot lines are formed.

Alternatively, it is also preferable that, in at least one of the plurality of the regions where the droplet deposition rate calculated in the droplet deposition rate calculation step is lower than a prescribed reference value, groups of the dots are formed in each of which m dots (where m is a positive integer) are aligned so as to mutually overlap by a prescribed overlap ratio in the main scanning direction, in accordance with the droplet deposition rate calculated in the droplet deposition rate calculation step, and a bent dot line is formed by arranging the groups of the dots, each including m dots, in the main scanning direction while staggering the groups of the dots in the sub-scanning direction. More specifically, it is also preferable that, in a region of high droplet deposition rate, dot lines are formed in the main scanning direction, and in a region of low droplet deposition rate, droplet deposition control is switched in such a manner that bent line-shaped dot lines are formed.

In order to attain the aforementioned object, the present invention is also directed to an image forming method for forming an image on a recording medium by forming dots on the recording medium by depositing droplets on the recording medium by a recording head having a plurality of nozzles ejecting the droplets while moving the recording head and the recording medium relatively to each other by conveying at least one of the recording head and the recording medium in a relative conveyance direction, wherein the image to be formed is divided into a plurality of regions; a density in each of the plurality of regions is set as a prescribed density so as to form the image; a droplet deposition rate is defined as a ratio of a number of the dots actually formed by depositing the droplets from one of the nozzles within each of the plurality of regions with respect to a maximum number of the dots formable by depositing the droplets from the one of the nozzles within the region; and tonal gradation in the image is represented by means of a collection of the dots based on a dot arrangement specified according to the droplet deposition rate calculated from image data of the image to be formed, the image forming method comprising: a droplet deposition rate calculation step of calculating the droplet deposition rate from the image data; a dot arrangement specification step of specifying a dot arrangement pattern from the droplet deposition rate calculated in the droplet deposition rate calculation step; and a droplet deposition control step of controlling droplet deposition operation performed by the recording head in such a manner that the dot arrangement pattern specified in the dot arrangement specification step is achieved, wherein, in at least one of the plurality of the regions where the droplet deposition rate calculated in the droplet deposition rate calculation step is lower than a prescribed reference value, an oblique dot line in a, direction oblique to a main scanning direction substantially perpendicular to the relative conveyance direction is formed in which the dots are continuously aligned so as to mutually overlap by a prescribed overlap ratio, in accordance with the droplet deposition rate calculated in the droplet deposition rate calculation step.

According to the present invention, in a region where the droplet deposition rate is lower than a prescribed reference value, an oblique dot line having a certain angle of inclination with respect to the main scanning direction is formed in accordance with the droplet deposition rate, and when forming this dot line, adjacent droplets are deposited so as to overlap mutually by a prescribed overlap rate. Therefore, even if a certain nozzle has suffered an ejection error, a portion of the missing dot is covered by the adjacent dots formed by other nozzles and hence banding caused by ejection errors is not conspicuous. Furthermore, in the present invention, it is possible to reduce the perceptibility of missing dots in a case where ejection errors have occurred, without having to include a step for detecting ejection errors in the nozzles.

Preferably, the oblique dot line is formed by progressively depositing the droplets in such a manner that positions at which the droplets are deposited by adjacent nozzles depositable the droplets onto pixel positions mutually adjacent in the main scanning direction are staggered by k (where k is a positive integer) pixels in a sub-scanning direction parallel to the relative conveyance direction when the droplet deposition rate is 1/n (where n is an integer not less than 2); and a value of k is determined in such a manner that a distance between dot lines, $x_0=n/(k^2+1)^{1/2}$, is less than a prescribed threshold value.

For example, the prescribed threshold value is set as a boundary condition at which non-uniformity in the density between respective oblique dot lines becomes perceptible. According to this mode, non-uniform density in the direction perpendicular to the oblique dot lines becomes less conspicuous.

Here the term "adjacent nozzles" does not only mean nozzles that are arranged in physically adjacent positions in the nozzle arrangement on the recording head, but also means nozzles having a positional relationship whereby they can deposit droplets to form dots that are substantially adjacent to each other on the recording medium. For example, in the case of a configuration where a plurality of nozzles are arranged two-dimensionally at high density, a case may arise where dots are formed at adjacent pixel positions on the recording medium by nozzles that are not necessarily adjacent in the nozzle arrangement. For the sake of convenience, nozzles which are able to eject droplets onto adjacent pixel positions on the recording medium in this way are called "adjacent nozzles".

In order to attain the aforementioned object, the present invention is also directed to an image forming method for forming an image on a recording medium by forming dots on the recording medium by depositing droplets on the recording medium by a recording head having a plurality of nozzles ejecting the droplets while moving the recording head and the recording medium relatively to each other by conveying at least one of the recording head and the recording medium in a relative conveyance direction, wherein the image to be formed is divided into a plurality of regions; a density in each of the plurality of regions is set as a prescribed density so as to form the image; a droplet deposition rate is defined as a ratio of a number of the dots actually formed by depositing the droplets from one of the nozzles within each of the plurality of regions with respect to a maximum number of the dots formable by depositing the droplets from the one of the nozzles within the region; and tonal gradation in the image is represented by means of a collection of the dots based on a dot arrangement specified according to the droplet deposition rate calculated from image data of the image to be formed, the image forming method comprising: a droplet deposition rate calculation step of calculating the droplet deposition rate from the image data; a dot arrangement specification step of specifying a dot arrangement pattern from the droplet deposition rate calculated in the droplet deposition rate calculation step; and a droplet deposition control step of controlling droplet deposition operation performed by the recording head in such a manner that the dot arrangement pattern specified in the dot arrangement specification step is achieved, wherein, in at least one of the plurality of the regions where the droplet deposition rate calculated in the droplet deposition rate calculation step is lower than a prescribed reference value, groups of the dots are formed in each of which m dots (where m is a positive integer) are aligned so as to mutually overlap by a prescribed overlap ratio in a main scanning direction substantially perpendicular to the relative conveyance direction, in accordance with the droplet deposition rate calculated in the droplet deposition rate calculation step, and a bent dot line is formed by arranging the groups of the dots, each including m dots, in the main scanning direction while staggering the groups of the dots in the sub-scanning direction.

According to the present invention, in a region where the droplet deposition rate is lower than a prescribed reference value, a prescribed number of dots (m dots) are aligned adjacently in the main scanning direction in accordance with the droplet deposition rate, and dot groups of this kind are arranged in the main scanning direction so as to stagger respectively in the sub-scanning direction, thereby forming a dot line having a bent line shape. In forming this dot line, adjacent droplets are deposited so as to overlap mutually by a prescribed overlap rate. Therefore, even if a certain nozzle has suffered an ejection error, a portion of the missing dot is covered by the adjacent dots formed by other nozzles and hence banding caused by ejection errors is not readily visible. Furthermore, in the present invention, it is possible to reduce the perceptibility of missing dots in a case where ejection errors have occurred, without having to include a step for detecting ejection errors in the nozzles. Here, it is preferable that m is an integer equal to 3 or more.

In order to attain the aforementioned object, the present invention is also directed to an image forming apparatus for forming an image on a recording medium by forming dots on the recording medium by depositing droplets on the recording medium by a recording head having a plurality of nozzles ejecting the droplets while moving the recording head and the recording medium relatively to each other by conveying at least one of the recording head and the recording medium in a relative conveyance direction, wherein the image to be formed is divided into a plurality of regions; a density in each of the plurality of regions is set as a prescribed density so as to form the image; a droplet deposition rate is defined as a ratio of a number of the dots actually formed by depositing the droplets from one of the nozzles within each of the plurality of regions with respect to a maximum number of the dots formable by depositing the droplets from the one of the nozzles within the region; and tonal gradation in the image is represented by means of a collection of the dots based on a dot arrangement specified according to the droplet deposition rate calculated from image data of the image to be formed, the image forming apparatus comprising: the recording head in which the plurality of nozzles are formed; a conveyance device which moves the recording head and the recording medium relatively to each other by conveying at least one of the recording head and the recording medium in the relative conveyance direction; a droplet deposition rate calculation device which calculates the droplet deposition rate from the image data; a dot arrangement specification device which specifies a dot arrangement pattern from the droplet deposition rate calculated by the droplet deposition rate calculation device; and a droplet deposition control device which controls droplet deposition operation performed by the recording head in such a manner that the dot arrangement pattern specified by the dot arrangement specification device is achieved, wherein droplet deposition is controlled so that, in at least one of the plurality of the regions where the droplet deposition rate calculated by the droplet deposition rate calculation device is lower than a maximum droplet deposition rate and is higher than a prescribed reference value, a dot line in a main scanning direction substantially perpendicular to the relative conveyance direction is formed in which the dots are continuously aligned so as to mutually overlap by a prescribed overlap ratio, in accordance with the droplet deposition rate calculated by the droplet deposition rate calculation device.

In order to attain the aforementioned object, the present invention is also directed to an image forming apparatus for forming an image on a recording medium by forming dots on the recording medium by depositing droplets on the recording medium by a recording head having a plurality of nozzles ejecting the droplets while moving the recording head and the recording medium relatively to each other by conveying at least one of the recording head and the recording medium in a relative conveyance direction, wherein the image to be formed is divided into a plurality of regions; a density in each of the plurality of regions is set as a prescribed density so as to form the image; a droplet deposition rate is defined as a ratio of a number of the dots actually formed by depositing the droplets from one of the nozzles within each of the plurality of regions with respect to a maximum number of the dots formable by depositing the droplets from the one of the nozzles within the region; and tonal gradation in the image is represented by means of a collection of the dots based on a dot arrangement specified according to the droplet deposition rate calculated from image data of the image to be formed, the image forming apparatus comprising: the recording head in which the plurality of nozzles are formed; a conveyance device which moves the recording head and the recording medium relatively to each other by conveying at least one of the recording head and the recording medium in the relative conveyance direction; a droplet deposition rate calculation device which calculates the droplet deposition rate from the image data; a dot arrangement specification device which specifies a dot arrangement pattern from the droplet deposition rate calculated by the droplet deposition rate calculation device; and a droplet deposition control device which controls droplet deposition operation performed by the recording head in such a manner that the dot arrangement pattern specified by the dot arrangement specification device is achieved, wherein droplet deposition is controlled so that, in at least one of the plurality of the regions where the droplet deposition rate calculated by the droplet deposition rate calculation device is lower than a prescribed reference value, an oblique dot line in a direction oblique to a main scanning direction substantially perpendicular to the relative conveyance direction is formed in which the dots are continuously aligned so as to mutually overlap by a prescribed overlap ratio, in accordance with the droplet deposition rate calculated by the droplet deposition rate calculation device.

In order to attain the aforementioned object, the present invention is also directed to an image forming apparatus for forming an image on a recording medium by forming dots on the recording medium by depositing droplets on the recording medium by a recording head having a plurality of nozzles ejecting the droplets while moving the recording head and the recording medium relatively to each other by conveying at least one of the recording head and the recording medium in a relative conveyance direction, wherein the image to be formed is divided into a plurality of regions; a density in each of the plurality of regions is set as a prescribed density so as to form the image; a droplet deposition rate is defined as a ratio of a number of the dots actually formed by depositing the droplets from one of the nozzles within each of the plurality of regions with respect to a maximum number of the dots formable by depositing the droplets from the one of the nozzles within the region; and tonal gradation in the image is represented by means of a collection of the dots based on a dot arrangement specified according to the droplet deposition rate calculated from image data of the image to be formed, the image forming apparatus comprising: the recording head in which the plurality of nozzles are formed; a conveyance device which moves the recording head and the recording medium relatively to each other by conveying at least one of the recording head and the recording medium in the relative conveyance direction; a droplet deposition rate calculation device which calculates the droplet deposition rate from the image data; a dot arrangement specification device which specifies a dot arrangement pattern from the droplet deposition rate calculated by the droplet deposition rate calculation device; and a droplet deposition control device which controls droplet deposition operation performed by the recording head in such a manner that the dot arrangement pattern specified by the dot arrangement specification device is achieved, wherein droplet deposition is controlled so that, in at least one of the plurality of the regions where the droplet deposition rate calculated by the droplet deposition rate calculation device is lower than a prescribed reference value, groups of the dots are formed in each of which m dots (where m is a positive integer) are aligned so as to mutually overlap by a prescribed overlap ratio in a main scanning direction substantially perpendicular to the relative conveyance direction, in accordance with the droplet deposition rate calculated by the droplet deposition rate calculation device, and a bent dot line is formed by arranging the groups of the dots, each including m dots, in the main scanning direction while staggering the groups of the dots in the sub-scanning direction.

A configuration example of a recording head in the above-described image forming apparatus is a full line type inkjet head having a nozzle row in which a plurality of nozzles for ejecting ink are arranged through a length corresponding to the full width of the recording medium.

In this case, a mode may be adopted in which a plurality of relatively short ejection head blocks having nozzles rows which do not reach a length corresponding to the full width of the recording medium are combined and joined together, thereby forming nozzle rows of a length that correspond to the full width of the recording medium.

A full line type inkjet head is usually disposed in a direction perpendicular to the relative feed direction (relative conveyance direction) of the recording medium, but modes may also be adopted in which the inkjet head is disposed following an oblique direction that forms a prescribed angle with respect to the direction perpendicular to the relative conveyance direction.

The term "recording medium" indicates a medium on which an image is recorded by means of the action of the recording head (this medium may also be called an ejection receiving medium, print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of an ejection head, and an intermediate transfer medium, and the like.

The conveyance device for causing the recording medium and the recording head to move relative to each other may include a mode where the recording medium is conveyed with respect to a stationary (fixed) recording head, or a mode where a recording head is moved with respect to a stationary recording medium, or a mode where both the ejection head and the recording medium are moved.

According to the present invention, a pattern for a dot arrangement according to which stripe-shaped non-uniformity (banding) is of low perceptibility is selected on the basis of a droplet deposition rate calculated from the image data that is to be printed, and a dot line is formed in which adjacent dots are mutually overlapping by a prescribed overlap rate. Therefore, even if ejection failure detection is not performed, it is possible significantly to reduce the perceptibility of dot faults in a case where an ejection error has occurred at a particular nozzle.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of Inkjet Recording Apparatus

Figure 1:
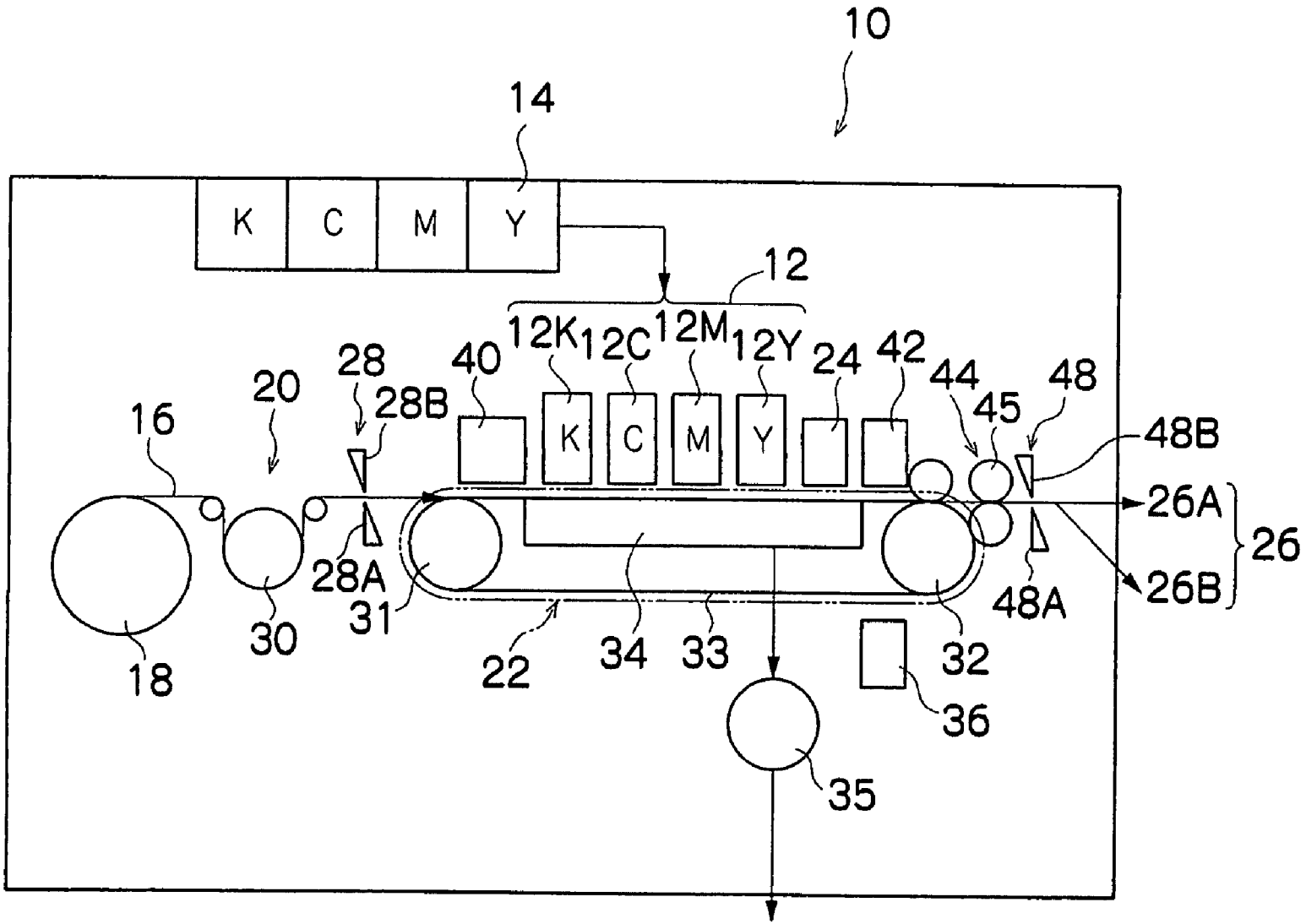
FIG. 1 is a general configuration diagram of an inkjet recording apparatus according to an embodiment of the present invention.

FIG. 1 is a general configuration diagram of an inkjet recording apparatus including an image forming apparatus according to an embodiment of the present invention. As shown in FIG. 1, the inkjet recording apparatus 10 comprises: a printing unit 12 having a plurality of inkjet heads (hereafter, called "heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16 which is a recording medium; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The ink storing and loading unit 14 has ink tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
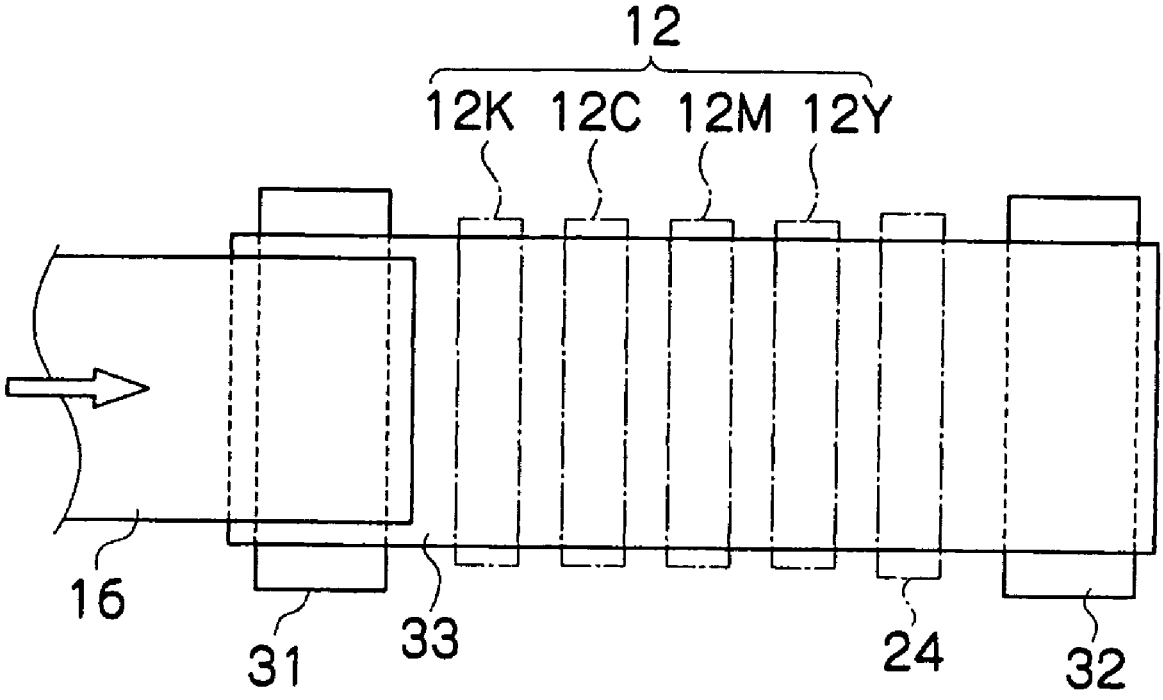
FIG. 2 is a plan view of the principal part of the peripheral area of a print unit in the inkjet recording apparatus illustrated in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 24 shown in FIG. 1 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

The present embodiment adopts an arrangement for droplet deposition which makes an image defect caused by ejection failure at a nozzle inconspicuous even when an ejection error has occurred at a nozzle, and is able to cover image defects of a certain extent, even without ejection failure detection. However, when the number of defective nozzles increases substantially, it is preferable to perform processing for restoring the defective nozzles by detecting ejection failures.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of the Head

Next, the structure of a head will be described. The heads 12K, 12C, 12M and 12Y of the respective ink colors have the same structure, and a reference numeral 50 is hereinafter designated to any of the heads.

Figure 3A:
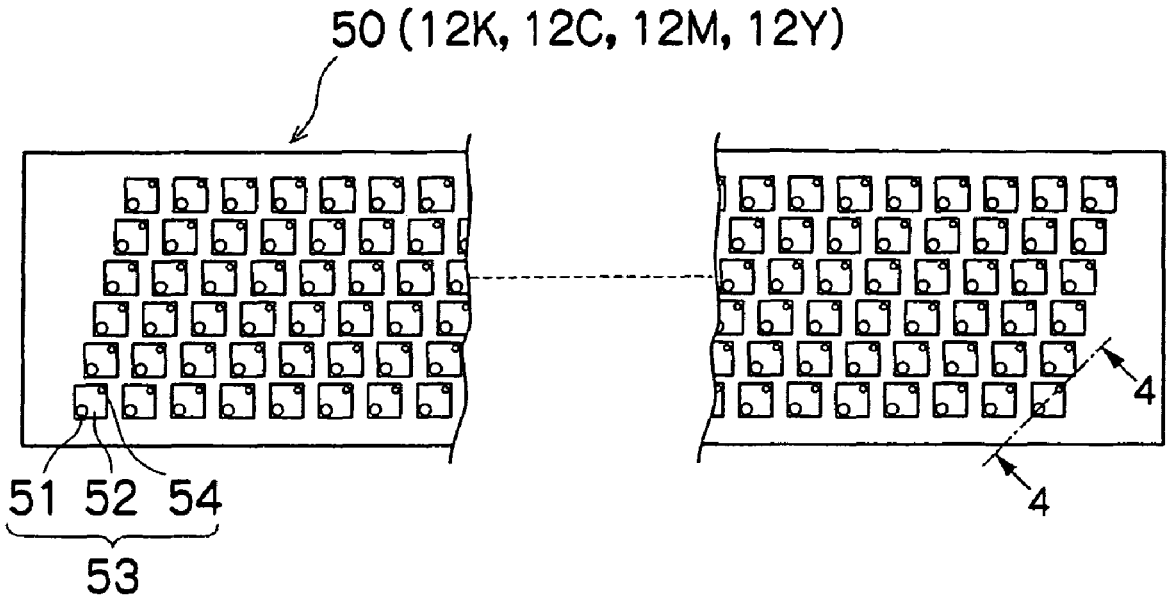
FIG. 3A is a perspective plan view showing an example of the composition of a print head.
Figure 3B:
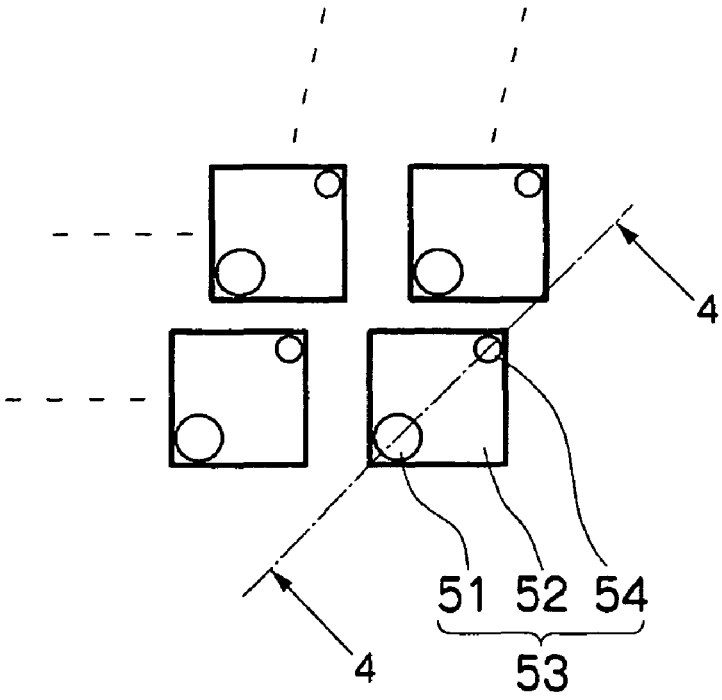
FIG. 3B is a principal enlarged view of FIG. 3A.
Figure 3C:
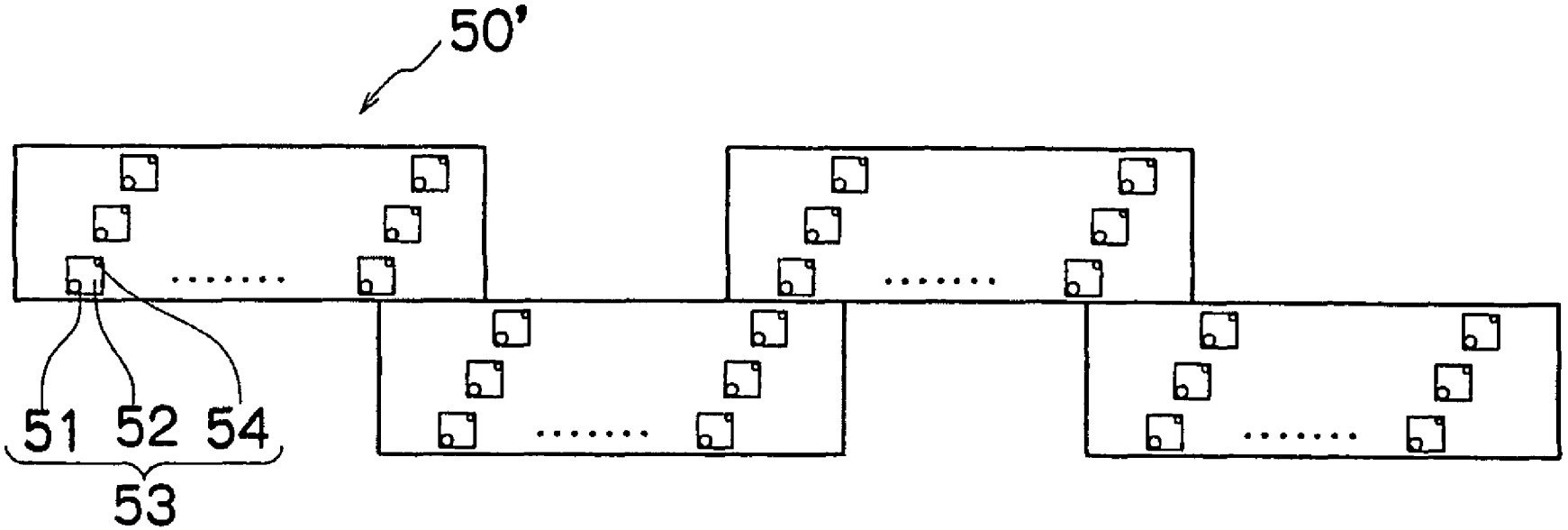
FIG. 3C is a perspective plan view showing another example of the configuration of a full line head.
Figure 4:
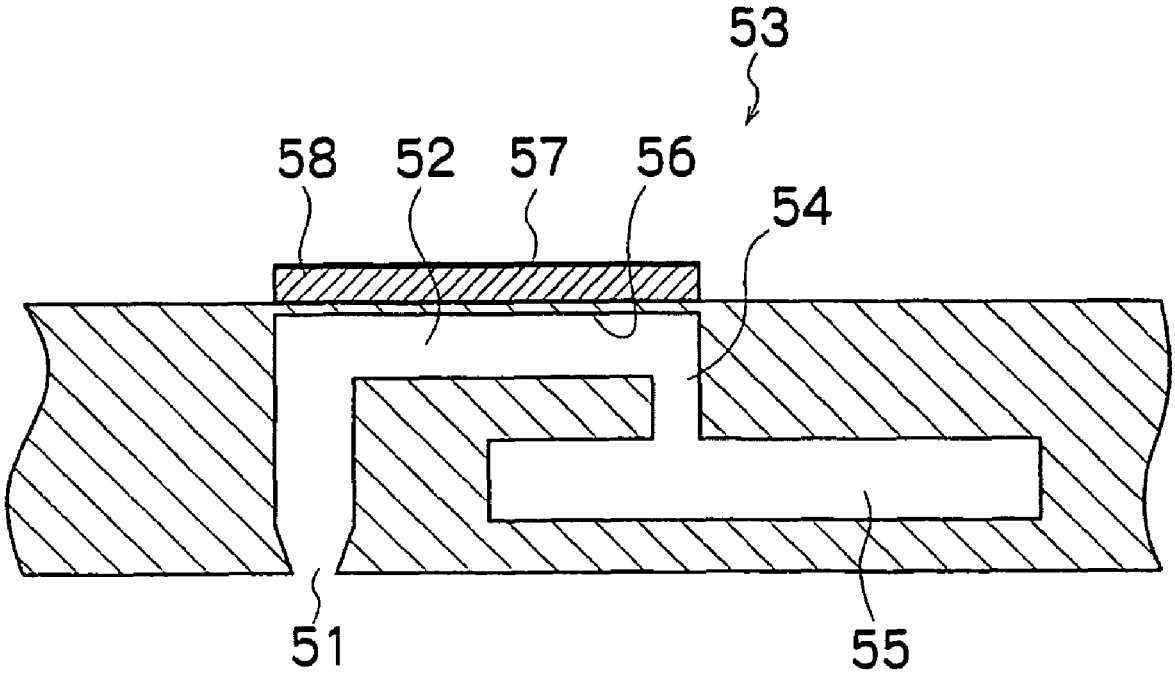
FIG. 4 is a cross-sectional view along line 4-4 in FIG. 3A.

FIG. 3A is a perspective plan view showing an example of the configuration of the head 50, FIG. 3B is an enlarged view of a portion thereof, FIG. 3C is a perspective plan view showing another example of the configuration of the head 50, and FIG. 4 is a cross-sectional view taken along the line 4-4 in FIGS. 3A and 3B, showing the inner structure of a droplet ejection element (an ink chamber unit for one nozzle 51).

The nozzle pitch in the head 50 should be minimized in order to maximize the density of the dots printed on the surface of the recording paper 16. As shown in FIGS. 3A and 3B, the head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 16 in a direction substantially perpendicular to the conveyance direction of the recording paper 16 is not limited to the example described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

As shown in FIGS. 3A and 3B, the planar shape of the pressure chamber 52 provided for each nozzle 51 is substantially a square, and an outlet to the nozzle 51 and an inlet of supplied ink (supply port) 54 are disposed in both corners on a diagonal line of the square.

As shown in FIG. 4, each pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

An actuator 58 provided with an individual electrode 57 is bonded to a pressure plate 56 (a diaphragm that also serves as a common electrode) which forms the ceiling of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common flow channel 55 through the supply port 54.

Figure 5:
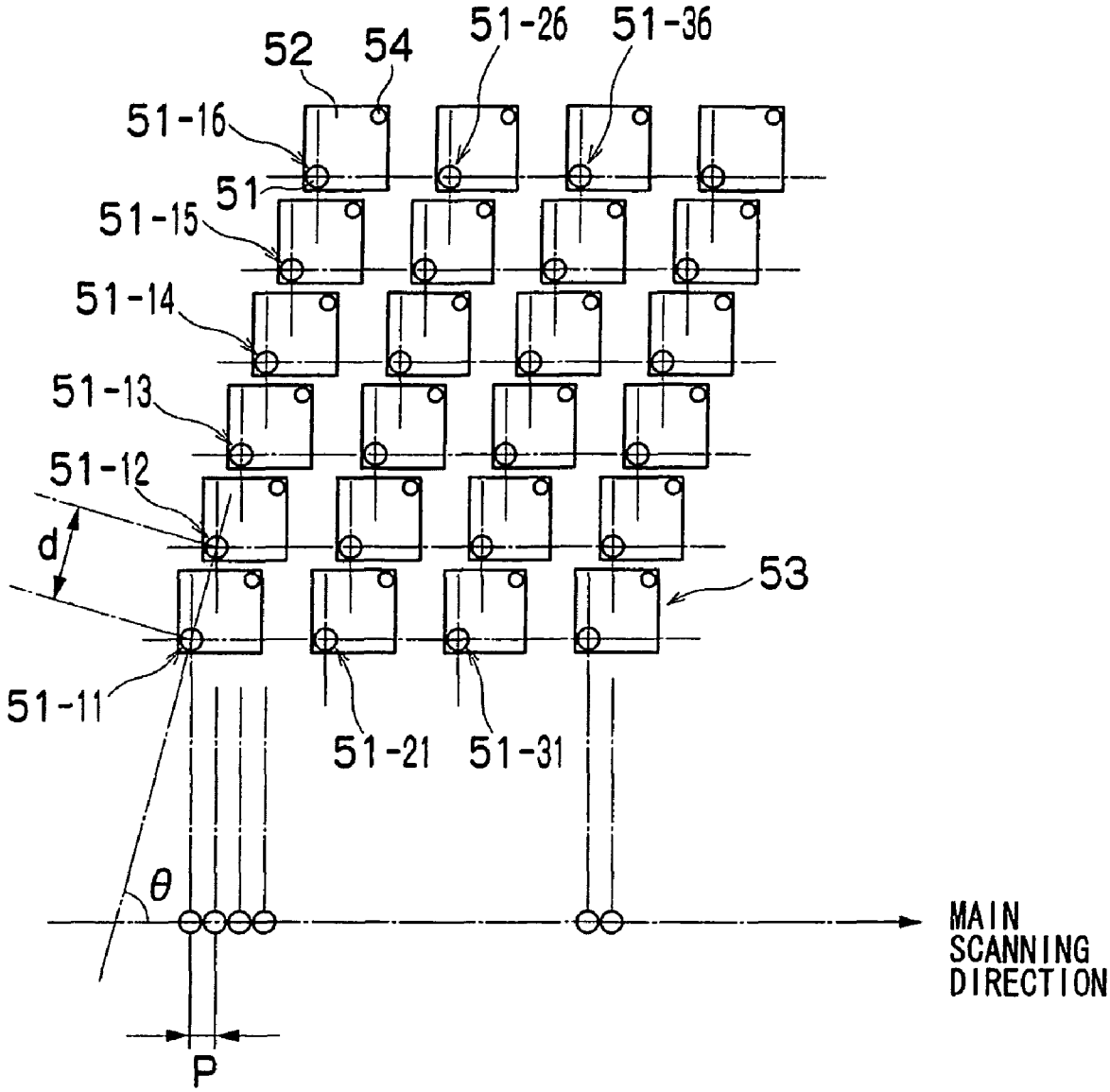
FIG. 5 is an enlarged view showing a nozzle arrangement in the print head illustrated in FIG. 3A.

As shown in FIG. 5, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Configuration of a Ink Supply System

Figure 6:
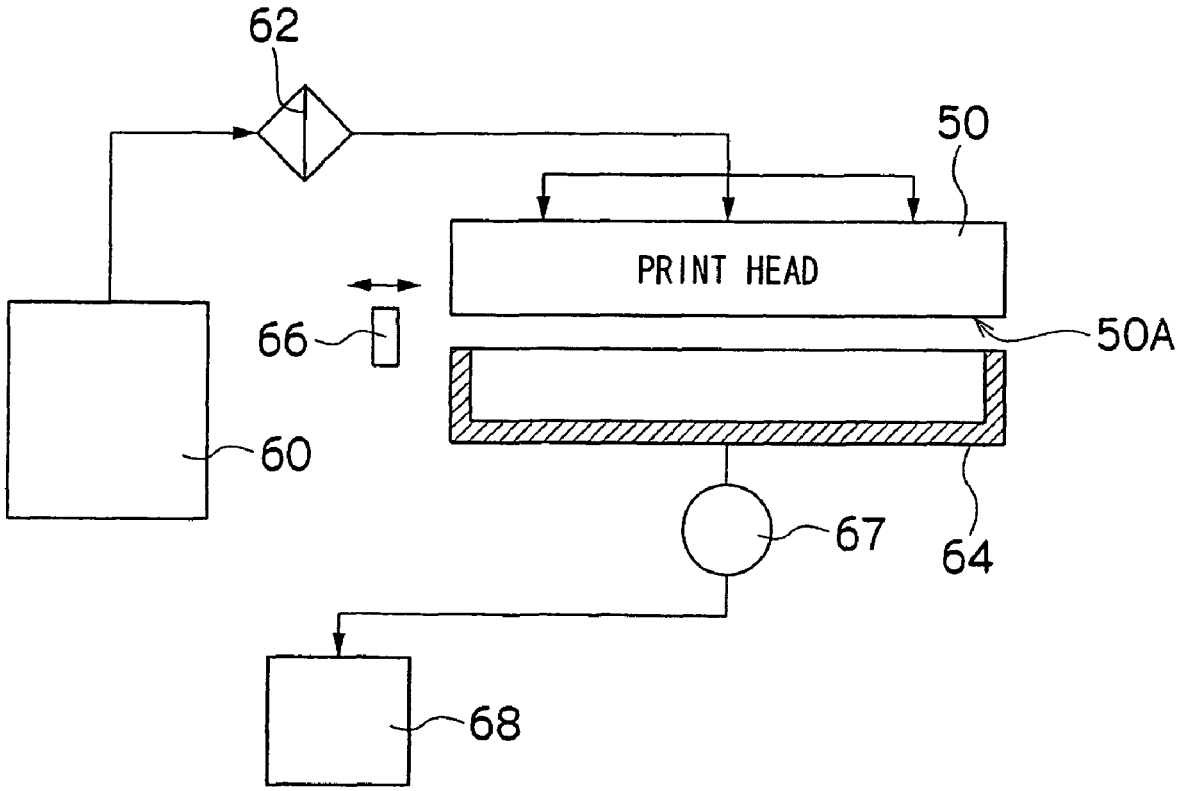
FIG. 6 is a schematic drawing showing the configuration of an ink supply system in the inkjet recording apparatus.

FIG. 6 is a schematic drawing showing the configuration of the ink supply system in the inkjet recording apparatus 10. The ink tank 60 is a base tank that supplies ink to the head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face 50A is thereby covered with the cap 64.

The cleaning blade 66 is composed of rubber or another elastic member, and can slide on the ink ejection surface (surface of the nozzle plate) of the head 50 by means of a blade movement mechanism (not shown). When ink droplets or foreign matter has adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink inside the pressure chamber 52 (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the head 50, or when service has started after a long period of being stopped.

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, ink can no longer be ejected from the nozzle 51 even if the actuator 58 is operated. Also, when the ink viscosity inside the nozzle 51 has increased over a certain level, ink can no longer be ejected from the nozzle 51 even if the actuator 58 is operated. In these cases, a suctioning device to remove the ink inside the pressure chamber 52 by suction with a suction pump, or the like, is placed on the nozzle face 50A of the head 50, and the ink in which bubbles have become intermixed or the ink whose viscosity has increased is removed by suction.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

Description of Control System

Figure 7:
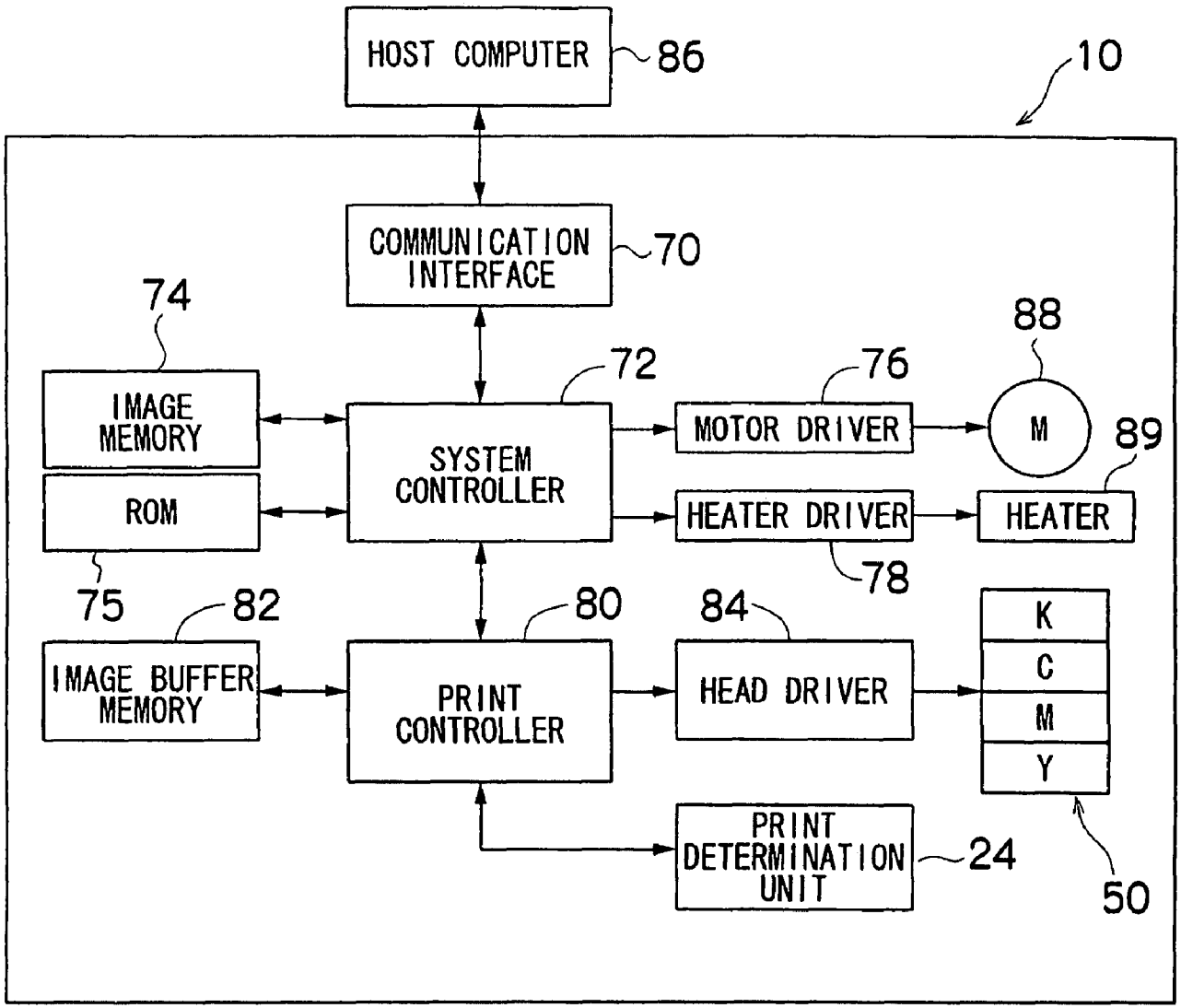
FIG. 7 is a principal block diagram showing the system composition of the inkjet recording apparatus.

FIG. 7 is a principal block diagram showing the system configuration of the inkjet recording apparatus 10. The inkjet recording apparatus 10 comprises a communication interface 70, a system controller 72, an image memory 74, a ROM 75, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 of the heads of the respective colors 12K, 12C, 12M and 12Y on the basis of print data supplied by the print controller 80. The head driver 84A can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color by means of the method according to the embodiment of the present invention, in the print controller 80. In other words, the print controller 80 performs processing for converting the inputted RGB image data into dot data for four colors, K, C, M and Y. The dot data generated by the print controller 80 is stored in the image buffer memory 82.

The head driver 84 generates drive control signals for the head 50 on the basis of the dot data stored in the image buffer memory 82. By supplying the drive control signals generated by the head driver 84 to the head 50, ink is ejected from the head 50. By controlling ink ejection from the heads 50 in synchronization with the conveyance velocity of the recording paper 16, an image is formed on the recording paper 16.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24. Furthermore, the system controller 72 implements control for carrying out preliminary ejection, suctioning, and other prescribed restoring processes on the head 50, on the basis of the information obtained from the print determination unit 24.

Droplet Deposition Control Method

Next, a method for controlling droplet deposition in an inkjet recording apparatus having the configuration described above will be explained. For the convenience of the description, the nozzle rows of the head 50 are simplified into a schematic model, and are rewritten as one nozzle row arranged linearly in the main scanning direction in the explanation, though the actual nozzle arrangement comprises a two-dimensional arrangement structure as described in FIGS. 3A to 3C.

In the inkjet recording apparatus 10, an image which appears to have a continuous tonal gradation to the human eye is formed by changing the dot formation density and the dot size of fine dots created by ink (coloring material), and therefore, the inputted digital image is converted into a dot pattern by means of a half-toning algorithm which reproduces the tonal gradations of the image (namely, the shades of the image) as faithfully as possible.

In the present embodiment, an image output method is employed in which the image to be formed is divided into certain regions, and the density is set to a prescribed density (a prescribed density determined on the basis of the data of the image that is to be formed) in each of these regions. In each region, the operating rates of the nozzles are substantially the same to each other. More specifically, in each region, substantially the same number of dots are formed by the nozzles. In this case, the ratio of the number of dots actually formed by one nozzle with respect to the maximum number of dots which can be formed by the one nozzle within the region (i.e., the number of pixels in the sub-scanning direction in the region), namely, "the number of droplets actually deposited by one nozzle/the maximum number of droplets which can be deposited by the one nozzle within the region (i.e., the number of pixels in the sub-scanning direction in the region)" is defined as the "droplet deposition rate". Since the operating rates of the nozzles are substantially the same to each other, then the droplet deposition rate is equal to "number of dots in the region/total number of pixels in the region".

The droplet deposition rates of the respective nozzles do not have to be precisely the same within a region. In effect, a range of variation of ±10% with respective to a reference nozzle deposition rate is tolerated.

In the present description, an indication method is used in which the droplet deposition rate is taken to be "1" (maximum droplet deposition rate) if the maximum depositable number of droplets are actually deposited (namely, if a "solid" image is printed), however the droplet deposition rate may be expressed in percentage.

Droplet Deposition Method 1

Figure 8B:
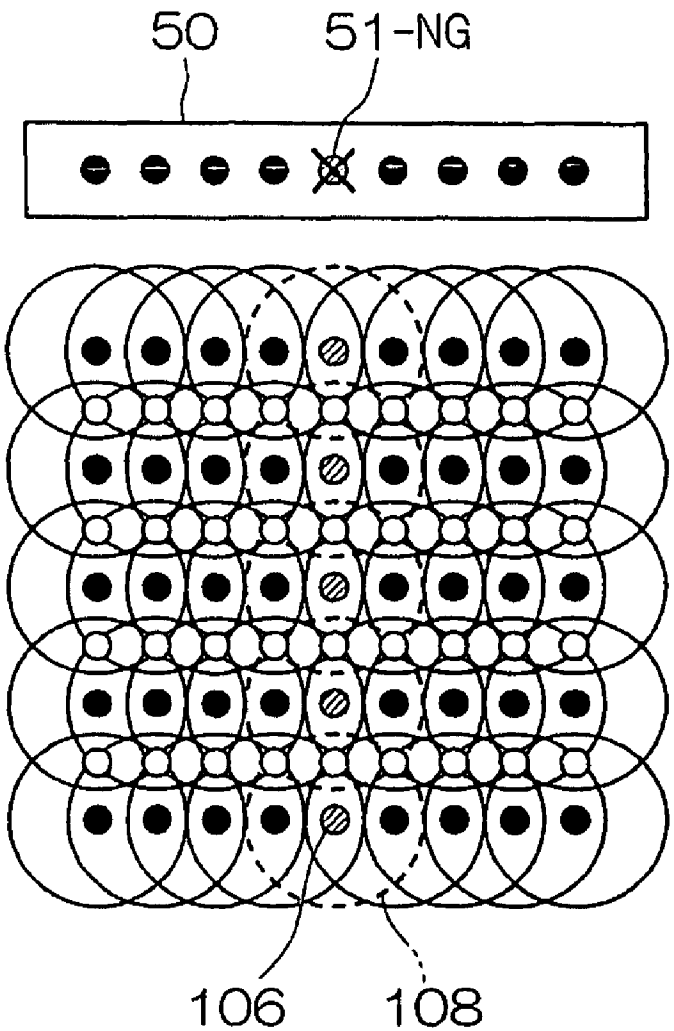
FIGS. 8A and 8B are schematic diagrams showing an example of the dot arrangement (droplet deposition rate ½) according to a first droplet deposition method.
Figure 8A:
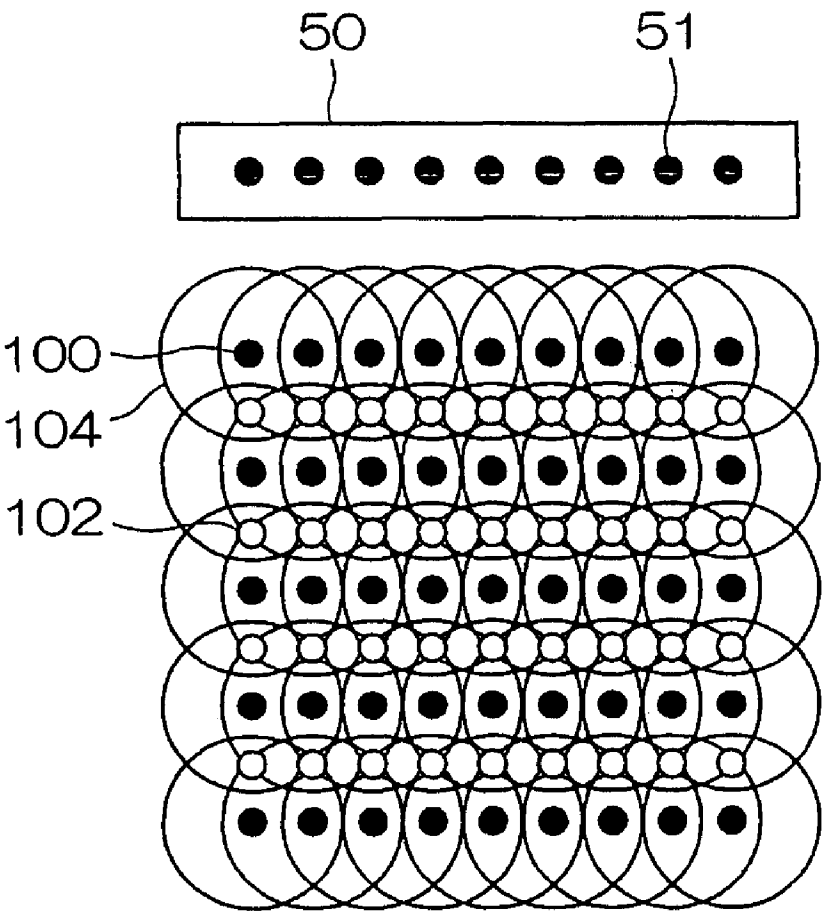

FIGS. 8A and 8B are schematic diagrams showing an example of an image (dot arrangement) recorded at a droplet deposition rate of ½. In FIGS. 8A and 8B, the recording medium is conveyed in the bottom to top direction in the plane of the drawing. Rows of dots aligned in the main scanning direction are formed successively by controlling the conveyance of the recording medium and the ink ejection timing from the nozzles 51.

The black circles 100 and the white circles 102 shown in the dot arrangement in FIGS. 8A and 8B indicate the positions at which droplets can be deposited by means of the nozzles 51 (namely, the pixel positions). The black circles 100 indicate the positions of pixels where droplets are actually deposited, and the white circles 102 indicate the positions of thinned out pixels where no droplets are deposited. Furthermore, circles 104 depicted centered on the black circles 100 represent dots formed by the spreading of the ink droplets deposited at the positions indicated by the black circles 100. The dimensions shown in FIGS. 8A and 8B are approximately 10 μm nozzle-to-nozzle distance and approximately 30 μm dot diameter, for example. The descriptions explained above with respect to FIGS. 8A and 8B apply similarly to the other diagrams, FIG. 10 to FIG. 15.

In the example shown in FIG. 8A, droplets are deposited at maximum density in the main scanning direction, without thinning out the droplet deposition positions (pixels), and droplets are deposited in every other pixel line in the sub-scanning direction. In this example, dots are arranged at a 50% ratio in the sub-scanning direction with respect to the maximum-density dot arrangement in which droplets can actually be deposited, and hence the droplet deposition rate is ½.

FIG. 8B shows an example of an image in a case where a nozzle 51-NG in the head 50 has produced an ejection failure in the droplet deposition method illustrated in FIG. 8A. The pixel positions shown by the obliquely hatched circles 106 in FIG. 8B have produced deposition failure and the row of dots 108 indicated by the dashed lines are missing from the image. However, in the case of a dot arrangement such as that depicted in FIGS. 8A and 8B, then even if a particular nozzle 51-NG has produced an ejection failure, if there are surrounding dots, then ink will be present in the region where the nozzle 51-NG producing the ejection failure should originally have deposited ink (more specifically, the surrounding dots will be present in this region), and therefore, banding can be prevented to a certain degree.

In other words, as shown in FIGS. 8A and 8B, a dot line in which respective dots are situated densely in a solid (i.e., the dots partially overlap with each other), consecutive arrangement in the main scanning direction can be said to have a strong effect in suppressing banding due to an ejection failure. A dot arrangement in which the dots are located in the most solid (dense) fashion possible is taken to be one dot line (a dot line in the main scanning direction) formed by depositing droplets at all of the pixels in the main scanning direction. This droplet deposition method is called a "first droplet deposition method".

The degree of overlap between mutually adjacent dots (overlap ratio) increases as the surface area of the region of the missing dot 108 which can be covered by the adjacent dots increases. The dots formed by deposited ink droplets have relatively high thickness in the center portion of the dot and relatively low thickness in the edge regions of the dot, and therefore it is desirable that adjacent dots be mutually overlapping in such a manner that the center portion of the missing dot 108 can be covered by adjacent dots.

Figure 9:
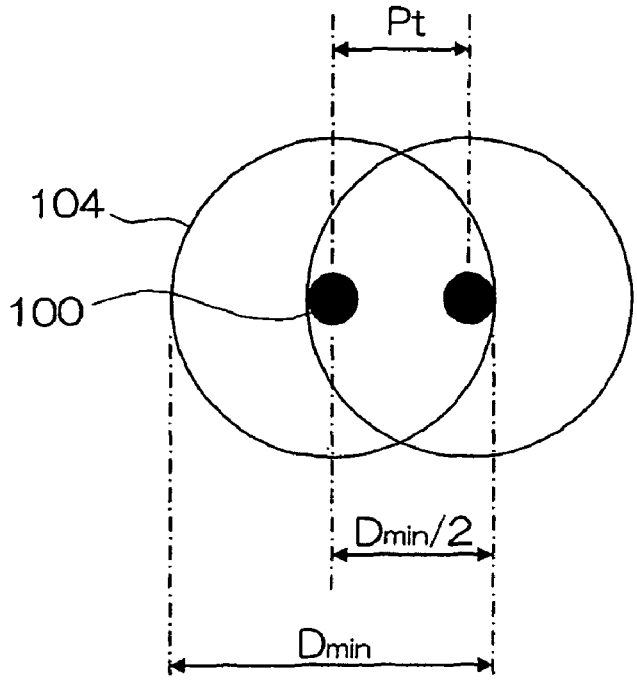
FIG. 9 is an illustrative diagram for describing the overlap conditions between adjacent dots.

More specifically, as shown in FIG. 9, if the minimum dot diameter formed by a nozzle 51 is taken to be Dmin, and the pitch between the dots is Pt, then it is preferable that the following relationship (1) is satisfied:

$$Dmin/2 \geqq Pt. \quad (1)$$

If the relationship (1) is satisfied, then it is possible to cover the central portion of a missing dot by means of the adjacent dots.

In the droplet deposition arrangement based on the first droplet deposition method described above, even if the phase of the dots forming a single row in the main scanning direction is staggered to some extent in the sub-scanning direction (in other words, by a smaller amount than the recording density in the sub-scanning direction), a similar effect can still be expected.

Furthermore, although the missing dot caused by the ejection failure is described as the example with reference to FIGS. 8A and 8B, deposition errors in the nozzle 51 also include other situations, apart from ejection failure (recording failure), such as abnormality in the ejection amount (dot size), abnormality in the dot formation position (droplet deposition position), and the like. All of these cases can be considered similarly to that of an ejection failure, in that insufficient ink is present in the region of the dots to originally have been formed.

If the droplet deposition rate is relatively high, then it is possible to cope with ejection failure by forming dot lines in the main scanning direction as illustrated in FIG. 8B; however, if the droplet deposition rate is low, in other words, supposing that the dot density is low, then the interval between one dot row and another dot row will become too large with this type of droplet deposition, and consequently, perceptible periodic non-uniformity will occur in the sub-scanning direction.

Figure 10:
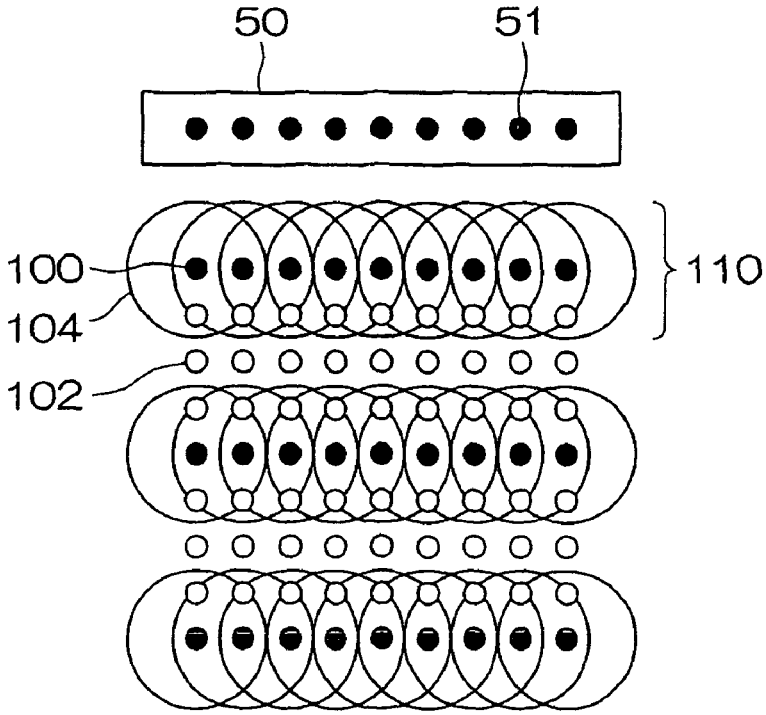
FIG. 10 is a schematic diagram of a case where dot lines parallel with the main scanning direction are formed at a droplet deposition rate of ¼.

FIG. 10 shows a schematic diagram of the dot lines in the main scanning direction formed when the droplet deposition rate is ¼. As shown in FIG. 10, the interval between the dot lines 110 in the main scanning direction is large and periodic non-uniformity occurs.

In order to avoid the situation shown in FIG. 10, in the inkjet recording apparatus 10 according to the present embodiment, the droplet deposition method described below is adopted in a region where the droplet deposition rate is low.

Droplet Deposition Method 2

Figure 11B:
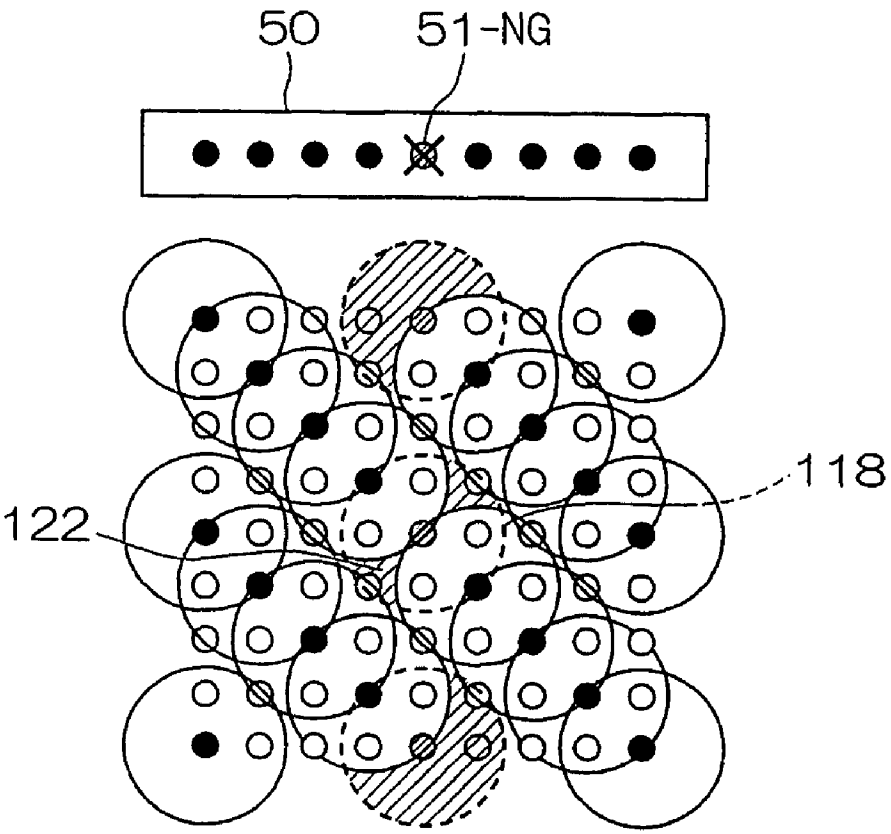
FIGS. 11A and 11B are schematic diagrams showing an example of the dot arrangement (droplet deposition rate ¼) according to a second droplet deposition method.
Figure 11A:
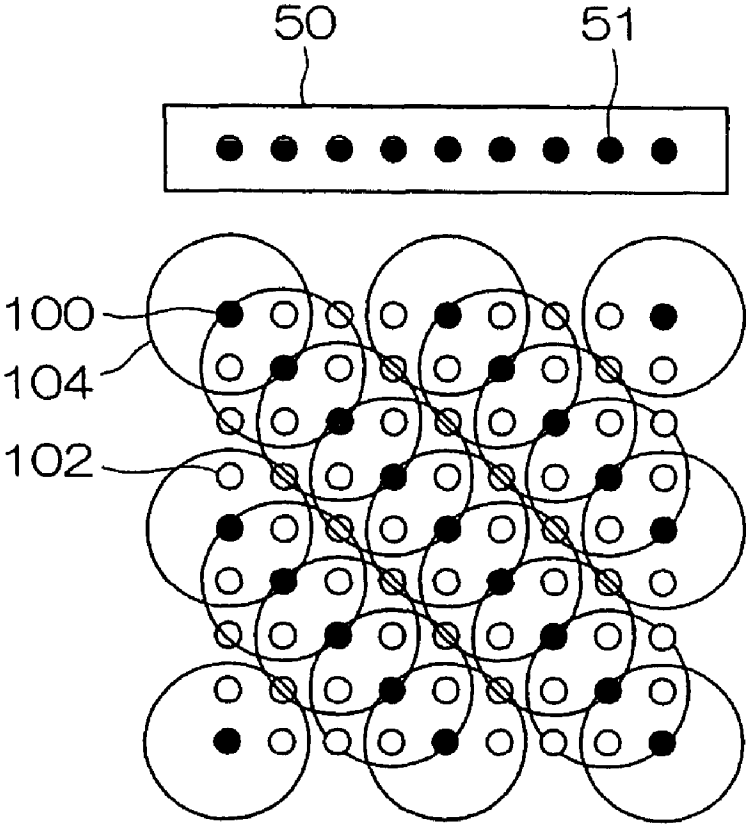

FIGS. 11A and 11B are schematic diagrams showing an example of a dot arrangement based on a second droplet deposition method. This droplet deposition method forms dot lines in a direction oblique to the main scanning direction, such that dot lines which are parallel in the main scanning direction in FIG. 8A are angled in the sub-scanning direction, in other words, the deposition of droplets from the nozzles 51 that are adjacent in the main scanning direction is staggered in the sub-scanning direction, as shown in FIG. 11A, the resulting dots being aligned consecutively in a mutually overlapping fashion on oblique straight lines forming a prescribed angle of inclination with respect to the main scanning direction.

FIGS. 11A and 11B show a case where the droplet deposition rate is ¼. As shown in FIG. 11B, even if a particular nozzle 51-NG is suffering an ejection failure, then the central portions of the missing dots 118 which should originally have been formed by the nozzle 51-NG are covered by the dots formed by the adjacent nozzles 51 (in FIG. 11B, these adjacent dots are formed at positions upper left and lower right from the ejection failure dots 118), and hence there is no loss of color. Furthermore, the regions 122 shown by the hatched lines in FIG. 11B where there is loss of color are the edge regions of the ejection failure dots 118, and hence it can be considered that there is virtually no variation in thickness compared to a case where normal (correct) ejection is performed as illustrated in FIG. 11A.

Figure 12B:
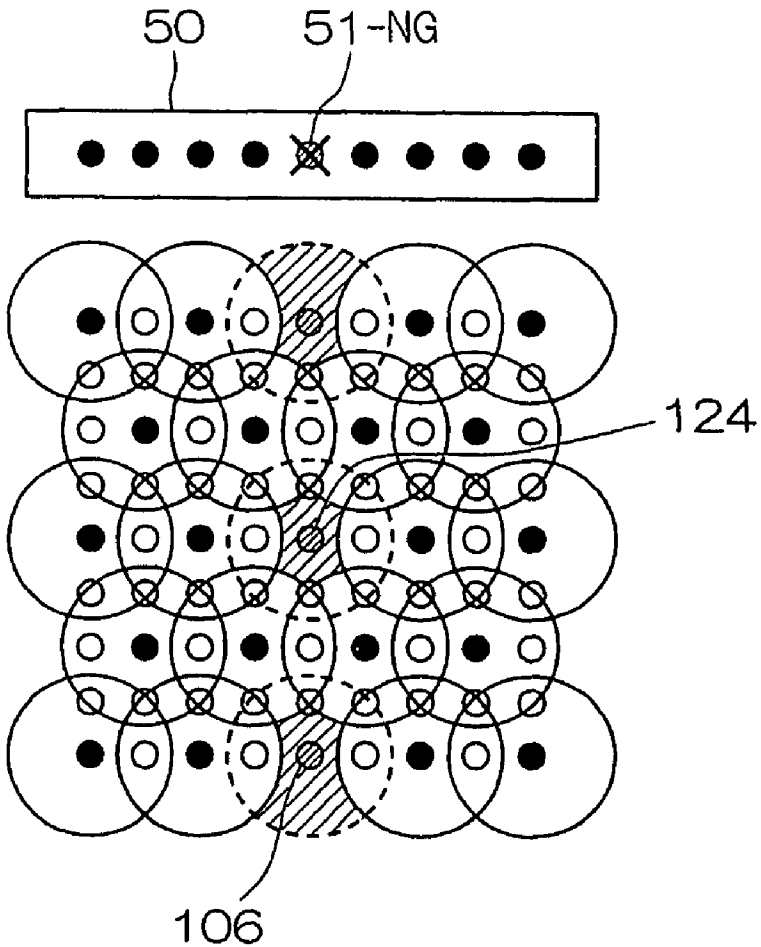
FIGS. 12A and 12B are schematic diagrams showing another example of a dot arrangement (staggered arrangement) where the droplet deposition rate is ¼.
Figure 12A:
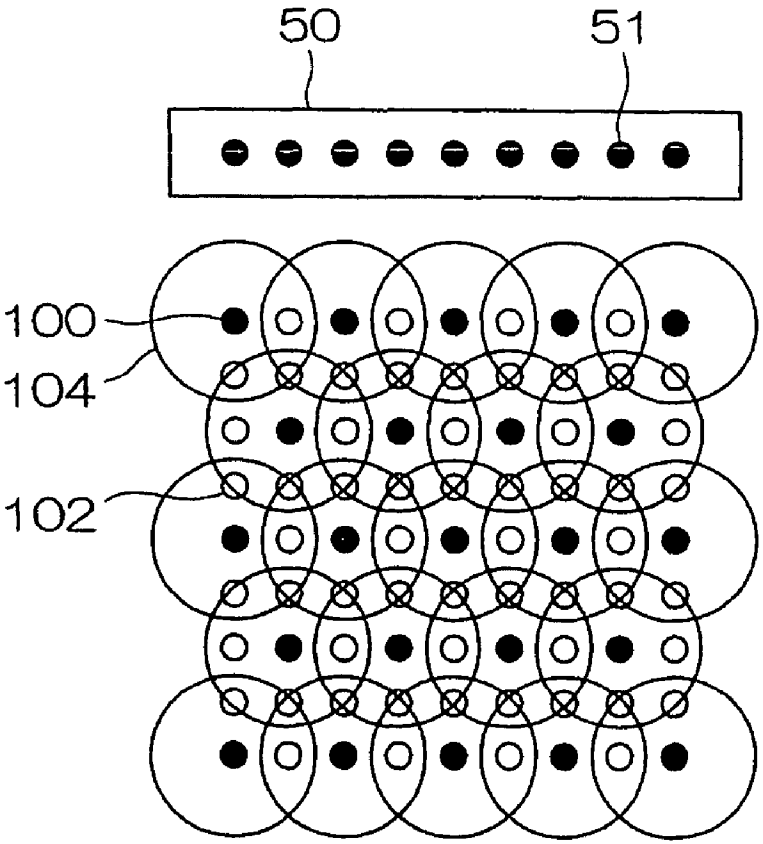

For the purpose of comparison, FIGS. 12A and 12B show an example of a further droplet deposition arrangement (staggered matrix arrangement) having a droplet deposition rate of ¼. In a staggered droplet deposition arrangement such as that shown in FIG. 12A, if a particular nozzle 51-NG suffers an ejection failure, then the center region 124 of the missing dots, where the thickness is expected to be the highest, remains empty as shown in FIG. 12B, and the striped banding becomes more conspicuous compared to the situation in FIG. 11B.

Figure 13:
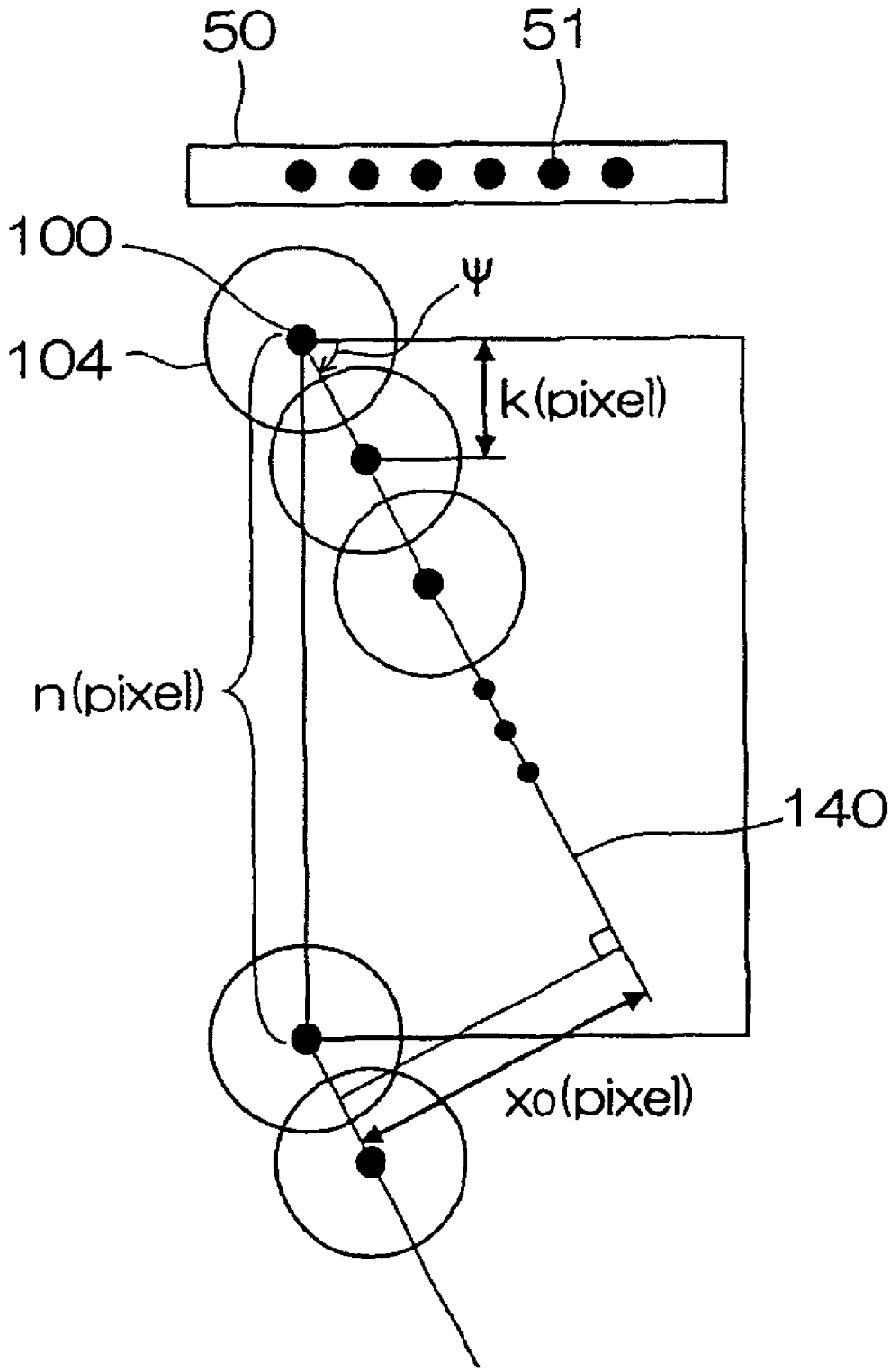
FIG. 13 is an illustrative diagram for describing a droplet deposition method where the droplet deposition rate is 1/n.

Here, a case where the droplet deposition rate is 1/n (droplet ejection is performed once every n times by each nozzle) in conjunction with the dot arrangement in FIG. 11A, is now considered with reference to FIG. 13. As shown in FIG. 13, it is supposed that an oblique dot line is progressively formed by depositing droplets by staggering the deposition from adjacent nozzles by k (pixels) in the sub-scanning direction.

In other words, the example in FIG. 11A corresponds to a case where k=1. Here, the minimum distance between the picture elements that can be achieved by depositing droplets is expressed by the unit "pixel".

As shown in FIG. 13, if the deposition of droplets from the nozzles 51 that are mutually adjacent in the main scanning direction is staggered progressively by k (pixels) in the sub-scanning direction, and if each of the nozzles 51 ejects a droplet once every n times (every n picture elements) in the sub-scanning direction, then a dot row is formed in which the dots are aligned in an oblique straight line 140 which changes by k (pixels) in the sub-scanning direction with respect to 1 (pixel) in the main scanning direction. If the angle of inclination of the dot row with respect to the main scanning direction is taken to be y, then the relationship tan ψ=k is established, and the value of k corresponds to a value which stipulates the direction of alignment of the dot row (in other words, the angle of inclination thereof).

By means of a simple calculation, the distance $x_0$ between dot rows formed mutually in parallel at a certain inclination of k is given by the following equation (2):

$$x_0=n/(k^2+1)^{1/2}\text{(pixel)}. \quad (2)$$

Here, $x_0$ indicates the repetition period of the obliquely arranged dot lines. Since the central region of a dot is the area of highest thickness and the edge regions of a dot are the areas of lowest thickness, then $x_0$ indicates the period of the shade pattern created by the obliquely arranged dot lines. Consequently, the inclination of the dot rows, in other words, the value of k, is set to as small a value as possible under conditions where the shade pattern of the period $x_0$ is not perceptible, and droplets are deposited in accordance with this set value of k.

Droplet Deposition Method 3

Figure 14B:
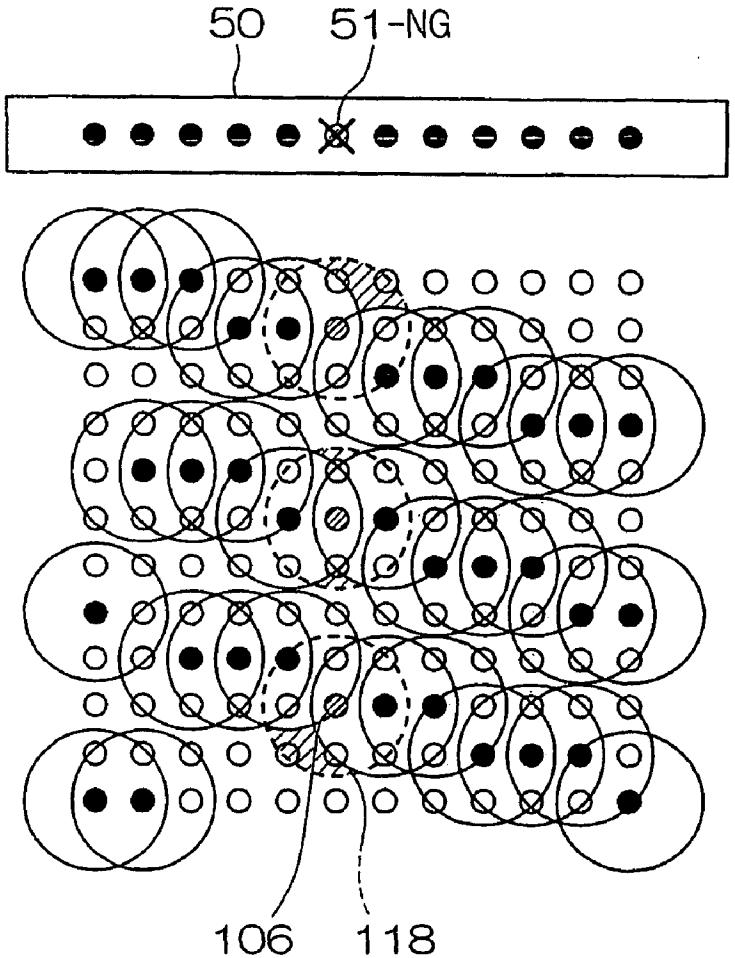
FIGS. 14A and 14B are schematic diagrams showing an example of the dot arrangement according to a third droplet deposition method.
Figure 14A:
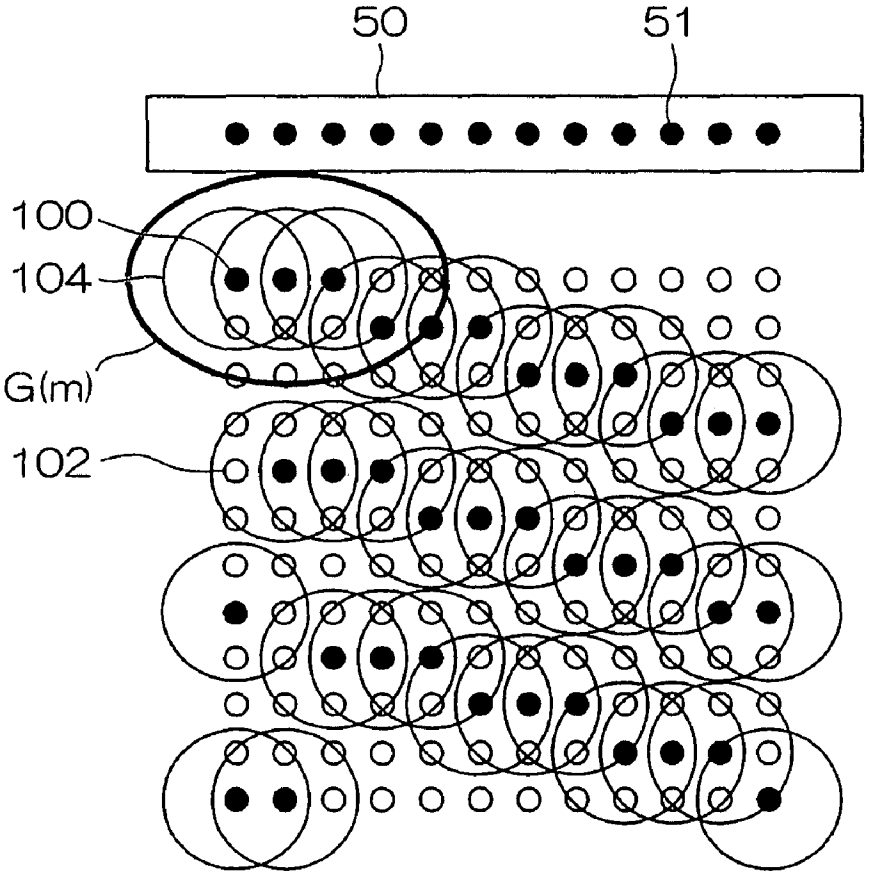

FIGS. 14A and 14B are schematic diagrams showing a dot arrangement based on a third droplet deposition method. As shown in FIGS. 14A and 14B, a plurality of dots (taken to be m dots, where m is an integer equal to three or above) are aligned in the main scanning direction, and such a group of m dots is expressed as G(m). These dot groups, G(m), are arranged in a staggered fashion in the sub-scanning direction, according to their positions in the main scanning direction. FIGS. 14A and 14B show an example where the droplet deposition rate is ¼ and m=3.

In this way, by forming the dot groups G(m) in a staggered fashion in the sub-scanning direction according to the position in the main scanning direction, even if dots 118 that have not been formed are located at the ends of the dot groups G(m) as shown in FIG. 14B, the color loss due to this ejection failure will occur at the edge portions of the missing dots, and therefore virtually no change in thickness will occur in comparison with normal (correct) ejection (FIG. 14A). Furthermore, if a dot in the center region of a dot group G(m) has been missing due to an ejection failure, then similarly to the example shown in FIG. 8B, the center region of the missing dot is covered by the adjacent dots.

If it is supposed that each of the nozzles 51 in the head 50 has a substantially uniform probability of suffering an ejection failure, then it is preferable that the droplets deposited to form the dot groups G(m) are deposited in a staggered fashion in the main scanning direction. On the other hand, if a nozzle suffering an ejection failure is previously identified, then a method may be adopted in which the whole droplet deposition arrangement is changed in order that the defective nozzle is located in the center region of a dot group G(m), thereby making the banding less conspicuous. In the droplet deposition arrangement described above, even if the phase of the dots aligned in a line in the main scanning direction is staggered to some extent in the sub-scanning direction (in other words, by a smaller amount than the recording density in the sub-scanning direction), a similar effect can still be expected.

Figure 15:
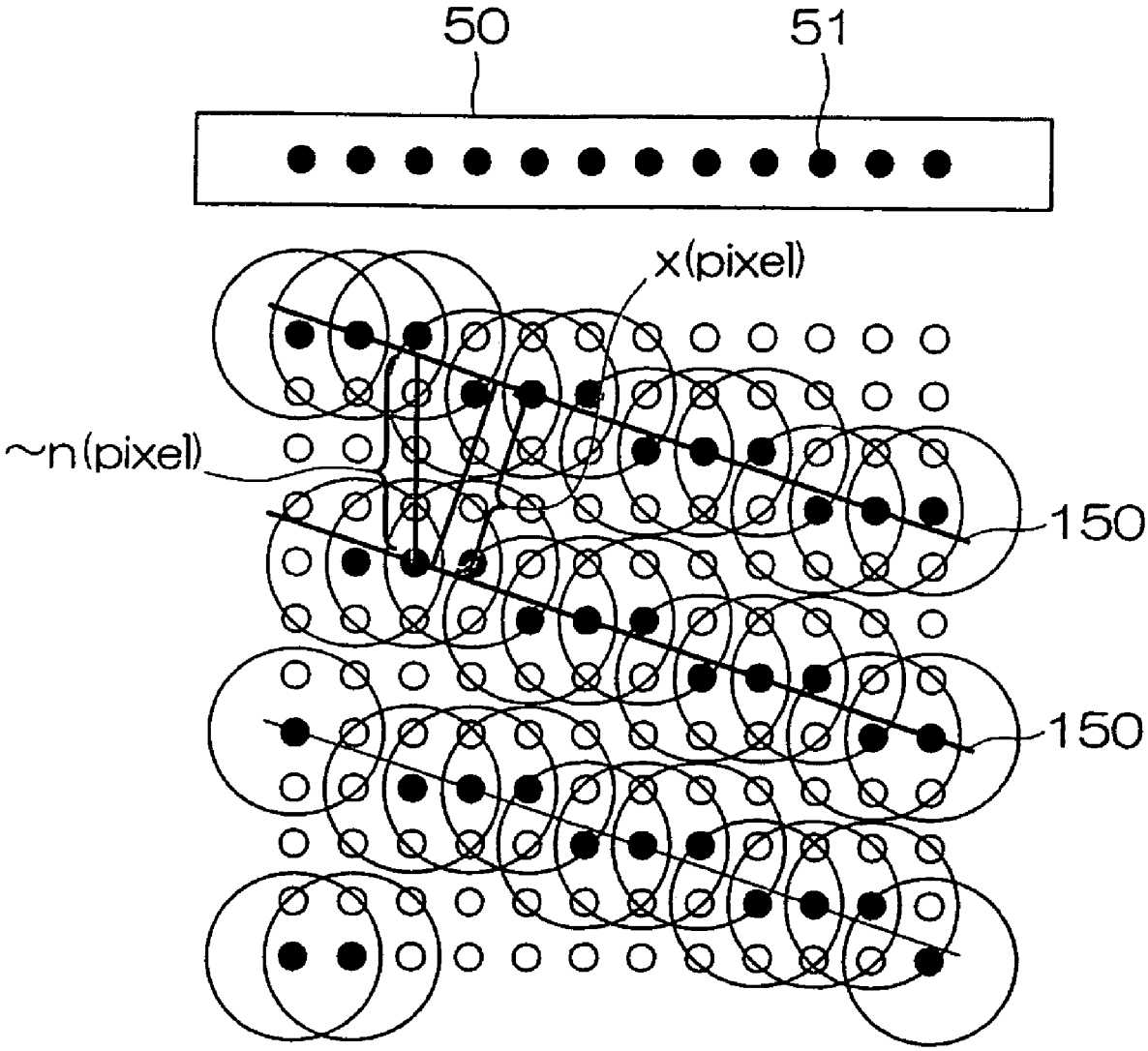
FIG. 15 is an illustrative diagram for describing a method of setting the number of dots m in the dot groups G(m) according to the third droplet deposition method.

In FIGS. 14A and 14B, m=3 is depicted as an example, but the value of m is set as appropriate. In the third droplet deposition method described in FIGS. 14A and 14B, it is possible that periodic non-uniformity of thickness may occur as shown in FIG. 15 in the direction substantially perpendicular to straight lines 150 which link the centers of the groups G(m), which are linked in a stepwise fashion. This interval x is given by the following equation (3):

$$x=m\times n/(m^2+1)^{1/2}\text{(pixel)}, \quad (3)$$

where m is the number of dots arranged in the main scanning direction, and 1/n is the droplet deposition rate.

If the threshold value of the interval at which banding due to non-uniform thickness is perceived is taken to be $x_t$, then it is preferable that the maximum value of m is used within a range where x does not exceed the threshold value $x_t$.

Since the ejection interval of one nozzle 51 is not always n (pixels), then it is considered that the interval may diverge to some extent from the calculated x value.

Furthermore, in FIGS. 14A, 14B and 15, examples are shown in which dots lines are formed in a bent line shape created by linking together m dot groups G(m) in a stepwise fashion in the main scanning direction. However, in implementing the present invention, it is also possible to form dot lines by linking together dot groups G(m) in the shape of a "W".

Threshold Value Accounting for Perceptibility of Image Deterioration

In the case of the inkjet recording apparatus 10 according to the present embodiment, droplet deposition is controlled in such a manner that, in a region of high droplet deposition rate, dots are arranged in a dense alignment in parallel with the main scanning direction as shown in FIG. 8A, whereas in a region where the droplet deposition rate is low, the dots are arranged in an oblique direction having an angle of inclination with respect to the main scanning direction as shown in FIG. 11A, or alternatively, m dots are aligned in the main scanning direction and respective dot groups (G(m)) are arranged in a staggered fashion in the sub-scanning direction according to their position in the main scanning direction as shown in FIG. 14A.

If the modes of the droplet deposition positions are thus changed within one image in accordance with the droplet deposition rates, then the threshold value (judgment reference value) at which the high droplet deposition rate (high density) is distinguished from the low droplet deposition rate (low density) and the droplet deposition methods are switched accordingly, is taken to be the droplet deposition rate at which periodic non-uniformity is perceptible in the sub-scanning direction. In practical terms, the actual value of the droplet deposition rate can be identified by observing an actual print.

Figure 16:
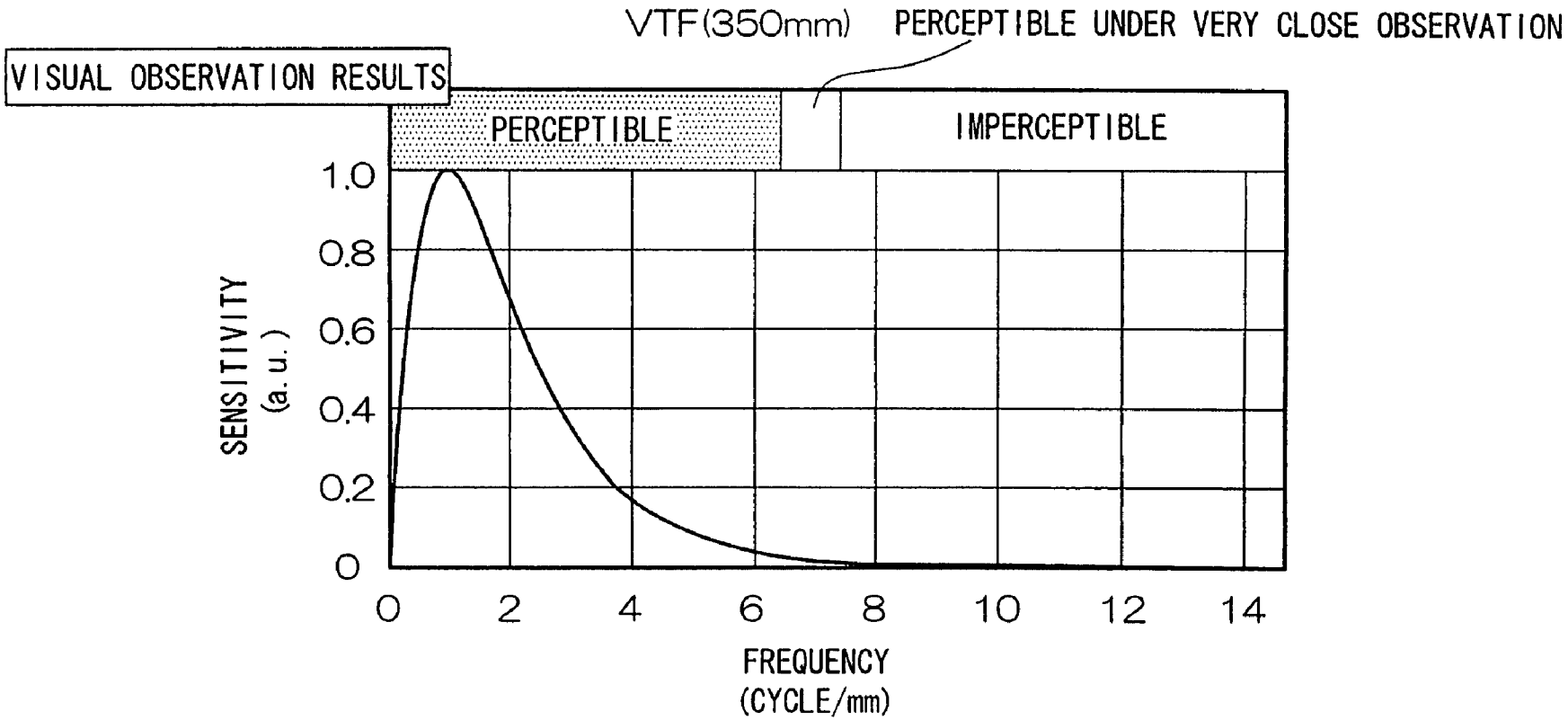
FIG. 16 is a diagram showing VTF and the results of actual visual observation.

FIG. 16 shows the spatial frequency characteristics (Visual Transfer Function: VTF) of the human eye and the results of actual observation. Here, the observation results are obtained by visual observation of samples in which droplets are deposited to form dots in a single straight line parallel to the main scanning direction as shown in FIG. 8A by a head having a nozzle density of 1,200 nozzles per inch (npi) at a dot formation density of 2,400 dots per inch (dpi). The observation distance is 350 mm. As shown in FIG. 16, from the actual visual observation results, it can be seen that low-frequency non-uniformity can be perceived from approximately 7 cycle/mm, and this coincides to a large degree with the VTF results. However, these results can be considered to significantly vary with the ink thickness and dot size, error in the droplet deposition position, the observation distance, and the like.

The threshold value of $x_0$ described with reference to FIG. 13 and the threshold value of x described with reference to FIG. 15 are appropriately set from a similar viewpoint to the foregoing.

The present embodiments have been described with respect to a configuration in which a plurality of full line heads are arranged respectively for different colors; however, in implementing the present invention, it is also possible to adopt a head configuration in which nozzle rows are formed respectively for different colors within an integrated multicolor head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming method for forming an image on a recording medium by forming dots on the recording medium by depositing droplets on the recording medium by a recording head having a plurality of nozzles ejecting the droplets while moving the recording head and the recording medium relatively to each other by conveying at least one of the recording head and the recording medium in a relative conveyance direction, wherein the image to be formed is divided into a plurality of regions; a density in each of the plurality of regions is set as a prescribed density so as to form the image; a droplet deposition rate is defined as a ratio of a number of the dots actually formed by depositing the droplets from one of the nozzles within each of the plurality of regions with respect to a maximum number of the dots formable by depositing the droplets from the one of the nozzles within the region; and tonal gradation in the image is represented by means of a collection of the dots based on a dot arrangement specified according to the droplet deposition rate calculated from image data of the image to be formed, the image forming method comprising:

a droplet deposition rate calculation step of calculating the droplet deposition rate from the image data;

a dot arrangement specification step of specifying a dot arrangement pattern from the droplet deposition rate calculated in the droplet deposition rate calculation step; and a droplet deposition control step of controlling droplet deposition operation performed by the recording head in such a manner that the dot arrangement pattern specified in the dot arrangement specification step is achieved, wherein, in at least one of the plurality of the regions where the droplet deposition rate calculated in the droplet deposition rate calculation step is lower than a maximum droplet deposition rate and is higher than a prescribed reference value, a dot line in a main scanning direction substantially perpendicular to the relative conveyance direction is formed in which the dots are continuously aligned so as to mutually overlap by a prescribed overlap ratio, in accordance with the droplet deposition rate calculated in the droplet deposition rate calculation step, wherein, in at least one of the plurality of the regions where the droplet deposition rate calculated in the droplet deposition rate calculation step is lower than a prescribed reference value, an oblique dot line in a direction oblique to the main scanning direction is formed in which the dots are continuously aligned so as to mutually overlap by a prescribed overlap ratio, in accordance with the droplet deposition rate calculated in the droplet deposition rate calculation step.

2. The image forming method as defined in claim 1, wherein, in at least one of the plurality of the regions where the droplet deposition rate calculated in the droplet deposition rate calculation step is lower than a prescribed reference value, groups of the dots are formed in each of which m dots (where m is a positive integer) are aligned so as to mutually overlap by a prescribed overlap ratio in the main scanning direction, in accordance with the droplet deposition rate calculated in the droplet deposition rate calculation step, and a bent dot line is formed by arranging the groups of the dots, each including m dots, in the main scanning direction while staggering the groups of the dots in the sub-scanning direction.

3. An image forming method for forming an image on a recording medium by forming dots on the recording medium by depositing droplets on the recording medium by a recording head having a plurality of nozzles ejecting the droplets while moving the recording head and the recording medium relatively to each other by conveying at least one of the recording head and the recording medium in a relative conveyance direction, wherein the image to be formed is divided into a plurality of regions; a density in each of the plurality of regions is set as a prescribed density so as to form the image; a droplet deposition rate is defined as a ratio of a number of the dots actually formed by depositing the droplets from one of the nozzles within each of the plurality of regions with respect to a maximum number of the dots formable by depositing the droplets from the one of the nozzles within the region; and tonal gradation in the image is represented by means of a collection of the dots based on a dot arrangement specified according to the droplet deposition rate calculated from image data of the image to be formed, the image forming method comprising:

a droplet deposition rate calculation step of calculating the droplet deposition rate from the image data;

a dot arrangement specification step of specifying a dot arrangement pattern from the droplet deposition rate calculated in the droplet deposition rate calculation step; and a droplet deposition control step of controlling droplet deposition operation performed by the recording head in such a manner that the dot arrangement pattern specified in the dot arrangement specification step is achieved, wherein, in at least one of the plurality of the regions where the droplet deposition rate calculated in the droplet deposition rate calculation step is lower than a prescribed reference value, an oblique dot line in a direction oblique to a main scanning direction substantially perpendicular to the relative conveyance direction is formed in which the dots are continuously aligned so as to mutually overlap by a prescribed overlap ratio, in accordance with the droplet deposition rate calculated in the droplet deposition rate calculation step.

4. The image forming method as defined in claim 3, wherein:

the oblique dot line is formed by progressively depositing the droplets in such a manner that positions at which the droplets are deposited by adjacent nozzles depositable the droplets onto pixel positions mutually adjacent in the main scanning direction are staggered by k (where k is a positive integer) pixels in a sub-scanning direction parallel to the relative conveyance direction when the droplet deposition rate is 1/n (where n is an integer not less than 2); and a value of k is determined in such a manner that a distance between dot lines, $x_0=n/(k^2+1)^{1/2}$, is less than a prescribed threshold value.

5. The image forming method as defined in claim 3, wherein dots in said oblique dot line are mutually overlapping such that a center portion of a missing dot is covered by adjacent dots.

6. The image forming method as defined in claim 3, wherein said prescribed reference value is a droplet deposition rate at which a periodic non-uniformity becomes perceptible in a sub-scanning direction.

7. The image forming method as defined in claim 3, wherein the recording head is a full line type head, and the image on the recording medium is formed according to a single pass recording in which the image is completed by a single sub-scanning between the recording head and the recording medium.

* * * * *